US010562163B2

(12) United States Patent
Akiba

(10) Patent No.: US 10,562,163 B2
(45) Date of Patent: Feb. 18, 2020

(54) DRIVING TOOL

(71) Applicant: MAKITA CORPORATION, Anjo-shi, Aichi (JP)

(72) Inventor: Yoshitaka Akiba, Anjo (JP)

(73) Assignee: MAKITA CORPORATION, Anjo-shi (JP)

( * ) Notice: Subject to any disclaimer, the term of this patent is extended or adjusted under 35 U.S.C. 154(b) by 274 days.

(21) Appl. No.: 15/647,766

(22) Filed: Jul. 12, 2017

(65) Prior Publication Data

US 2018/0015600 A1 Jan. 18, 2018

(30) Foreign Application Priority Data

Jul. 12, 2016 (JP) ..... 2016-137921
Mar. 3, 2017 (JP) ..... 2017-040951

(51) Int. Cl.
*B25C 1/06* (2006.01)
*B25C 1/00* (2006.01)

(52) U.S. Cl.
CPC ..... *B25C 1/06* (2013.01); *B25C 1/008* (2013.01)

(58) Field of Classification Search
CPC ..... B25C 1/06; B25C 5/15; B25C 1/0008
USPC ..... 227/8, 120, 131, 133, 129, 156, 139; 170/90–138, 200–212; 5/13, 15
See application file for complete search history.

(56) References Cited

U.S. PATENT DOCUMENTS 4,463,888 A * 8/1984 Geist ..... B25C 1/005 227/109
5,069,379 A * 12/1991 Kerrigan ..... B25C 1/06 227/120
7,204,403 B2 * 4/2007 Kenney ..... B25C 1/06 227/120
8,123,099 B2 * 2/2012 Kenney ..... B25C 1/06 227/120
8,231,039 B2 * 7/2012 Buck ..... B25C 1/06 227/120
8,302,833 B2 * 11/2012 Gross ..... B25C 1/06 227/134
9,126,319 B2 9/2015 Gross et al.
2005/0218181 A1 * 10/2005 Gross ..... B25C 1/06 227/130

(Continued)

OTHER PUBLICATIONS

Nov. 27, 2017 Search Report issued in European Patent Application No. 17180607.8.

*Primary Examiner* — Alexander M Valvis
*Assistant Examiner* — Himchan "Aiden" Song
(74) *Attorney, Agent, or Firm* — Oliff PLC

(57) ABSTRACT

A driving tool includes a flywheel, a driver held to be movable between an initial position and a driving position along an movement axis, a ring member configured to transmit rotational energy of the flywheel to the driver, and a driver moving mechanism configured to move the driver with respect to the ring member from the initial position to a transmitting position. When the driver is placed in the initial position, the ring member is disposed loosely around the outer periphery of the flywheel. When the driver is moved to the transmitting position by the driver moving mechanism, the ring member is frictionally engaged with the driver and with the flywheel, rotated by the flywheel, and transmits the rotational energy to the driver, thereby pushing the driver from the transmitting position toward the driving position.

14 Claims, 19 Drawing Sheets

(56) References Cited

U.S. PATENT DOCUMENTS

| | | | | |
|---|---|---|---|---|
| 2008/0257933 | A1* | 10/2008 | Takahashi | B25C 1/06 227/129 |
| 2011/0094847 | A1* | 4/2011 | Hirabayashi | B25C 1/06 192/105 R |
| 2015/0034345 | A1* | 2/2015 | Po | B25C 1/06 173/46 |

* cited by examiner

DRIVING TOOL

CROSS-REFERENCE TO RELATED APPLICATION

The present application claims priority to Japanese patent application No. 2016-137921 filed on Jul. 12, 2016, and Japanese patent application No. 2017-40951 filed on Mar. 3, 2017. The contents of the foregoing applications are incorporated herein by reference in their entirety.

TECHNICAL FIELD

The present invention relates to a driving tool for driving a fastener into a workpiece by driving out the fastener.

BACKGROUND

A driving tool is known which is configured to drive out a fastener such as a nail by linearly moving a driver. For example, in a driving tool disclosed in U.S. Pat. No. 9,126,319, a follower driven by an actuator presses the driver against a flywheel rotating below the driver. Then the rotational energy of the flywheel is transmitted to the driver. The driver is pushed forward along a driving axis and drives out a nail from a nose.

SUMMARY

In the above-described driving tool, the follower presses a specific region of the driver held in a stationary state against the flywheel rotating at high speed. Thus, the specific region is more easily worn out than the other regions. Therefore, the above-described driving tool may need further improvement to enhance the durability of the driver.

Accordingly, it is an object of the present invention to provide a technique that helps enhance the durability of a driver, in a driving tool for driving a fastener into a workpiece by driving out the fastener with the driver.

According to an aspect of the present invention, a driving tool is provided which is configured to drive a fastener into a workpiece by driving out the fastener. The driving tool includes a flywheel, a driver, a ring member and a driver moving mechanism.

The flywheel is configured to be rotationally driven around a first rotation axis. The driver is disposed to face an outer periphery of the flywheel in a radial direction of the flywheel. The driver is held to be movable between an initial position and a driving position along a movement axis. The ring member is configured to transmit rotational energy of the flywheel to the driver. The driver moving mechanism is configured to move the driver with respect to the ring member from the initial position to a transmitting position in which the ring member is capable of transmitting the rotational energy to the driver.

When the driver is placed in the initial position, the ring member is disposal loosely around the outer periphery of the flywheel. Further, when the driver is moved to the transmitting position by the driver moving mechanism, the ring member is frictionally engaged with the driver and with the flywheel, and rotated by the flywheel around a second rotation axis, which is different from the first rotation axis, and transmits the rotational energy to the driver, thereby pushing the driver in a driving direction from the transmitting position toward the driving position.

In the driving tool having such a structure, the driver is pushed toward the driving position by the rotational energy of the flywheel which is transmitted via the ring member. When the driver is placed in the initial position, the ring member is disposed loosely around the flywheel, but when the driver is moved to the transmitting position, the ring member is frictionally engaged with the driver and with the flywheel and rotated by the flywheel. With this structure, the driver is not directly pressed against the flywheel which is rotating at high speed. Thus, wear of the driver can reliably be suppressed. In other words, the durability of the driver can be enhanced. Further, although the ring member may need to be replaced when the ring member is worn out, the ring member is generally inexpensive compared with the driver. Therefore, the cost for the replacement can be reduced.

Further, when transmitting the rotational energy to the driver, the ring member rotates around the second rotation axis which is different from the first rotation axis. Therefore, the same region of the ring member does not always come in contact with the flywheel at the start of the transmission, so that wear of only a specific region of the ring member can be prevented.

According to an aspect of the present invention, the driving tool may further include a holding mechanism that is configured to hold the ring member such that the ring member is movable between a separate position and a contact position. The ring member may be held apart from the outer periphery of the flywheel in the separate position, and may be held in partial contact with the outer periphery of the flywheel in the contact position. The holding mechanism may be configured to hold the ring member at the separate position when the driver is placed in the initial position, and to hold the ring member, which is moved in response to a movement of the driver, at the contact position when the driver is moved to the transmitting position by the driver moving mechanism.

In the driving tool according to this aspect, when the driver is placed in the initial position, the ring member is held at the separate position and is not rotated by the flywheel. On the other hand, the ring member is moved to the contact position in response to the movement of the driver to the transmitting position, held by the holding mechanism and rotated in partial contact with the outer periphery of the flywheel. With the holding mechanism having such a structure, the timing when the ring member starts rotating can be properly linked with the movement of the driver to the transmitting position.

According to an aspect of the present invention, the transmitting position may be located between the initial position and the driving position in the direction of the movement axis. The driver moving mechanism may be configured to push the driver from the initial position toward the transmitting position along the movement axis. With such a structure, the transmitting position is located on the way of the driver moving from the initial position toward the driving position along the movement axis, so that the driver can be smoothly moved to the driving position in a series of operations.

According to an aspect of the present invention, the driving tool may further include a restricting part that is configured to restrict a movement of the driver away from the flywheel in a facing direction in which the driver and the outer periphery face each other. The driver may have an inclined part which is configured to come in contact with the ring member in a process in which the driver moves from the initial position to the transmitting position. The inclined part may be configured to have a thickness in the facing direction which gradually increases in a direction opposite to the driving direction. With such a structure, the driver moves from the initial position to the transmitting position while its movement away from the flywheel is restricted by the restricting part. In this process, the inclined part having the thickness gradually increasing in a direction opposite to the driving direction comes in contact with the ring member. Therefore, the inclined part can function as a cam and also exhibit a wedge effect to efficiently move the ring member toward the outer periphery of the flywheel.

According to an aspect of the present invention, the driving tool may further include a restricting part that is configured to restrict a movement away from the flywheel in a facing direction in which the driver and the outer periphery of the flywheel face each other. The restricting part may include a contact member that is configured to come in contact with the driver, and a biasing member that is configured to bias the driver, via the contact member, toward the flywheel in the facing direction. The driver may have a contact surface that is configured to come in contact with the contact member when the driver moves from the transmitting position to the driving position. At least a section of a contact region of the driver may be configured to have a thickness in the facing direction which gradually increases in a direction opposite to the driving direction. Here, the contact region is a region of the driver that corresponds to the contact surface in the direction of the movement axis. With such a structure, the driver moves from the transmitting position to the driving position while being held in contact with the contact surface of the contact member and biased toward the flywheel. At this time, with the structure in which at least a section of the contact region of the driver which corresponds to the contact surface is configured, to have a thickness gradually increasing in a direction opposite to the driving direction, the biasing force of the biasing member increases as the driver moves. As a result, the driver can be prevented from sliding with respect to the ring member by reaction force from the fastener.

According to an aspect of the present invention, the driver may include two engagement parts extending in the direction of the movement axis and disposed on opposite sides of the movement axis. The driving tool may include two of the ring members that are respectively engageable with the two engagement parts of the driver. With such a structure, the two ring members respectively engage with the two engagement parts on the opposite sides of the movement axis, so that the driver can be moved in the driving direction in a stable attitude.

According to an aspect of the present invention, the ring member may include a first engagement part which is configured to be engageable with the driver and a second engagement part which is configured to be engageable with the flywheel. The first and second engagement parts may be formed as projections that are configured to be respectively engageable with a groove formed in the driver in the direction of the movement axis and a groove formed in the outer periphery of the flywheel in a circumferential direction. Alternatively, the first and second engagement pails may be formed as recesses that are configured to be respectively engageable with a projection formed in the driver in the direction of the movement axis and a projection formed in the outer periphery of the flywheel in the circumferential direction. With such a structure, reliable transmission of the rotational energy from the flywheel to the driver can be secured.

According to an aspect of the present invention, the first engagement part may be configured to engage with the groove or the projection of the driver at two engagement positions in a direction of the second rotation axis. The second engagement part may be configured to engage with the groove or the projection of the flywheel at two engagement positions in the direction of the second rotation axis. In this case, preferably, a virtual plane perpendicular to the second rotation axis and passing a midpoint, in the direction of the second rotation axis, between the two engagement positions at which the first engagement part and the driver are engaged with each other may also pass a midpoint, in the direction of the second rotation axis, between the two engagement positions at which the second engagement part and the flywheel are engaged with each other. With such a structure, the ring member and the driver, and the ring member and the flywheel are respectively engaged with each other at engagement positions which are equally apart from the same virtual plane in the direction of the second rotation axis. Therefore, the ring member can rotate in engagement with the flywheel and the driver in a stable attitude.

According to an aspect of the present invention, both the first and second engagement parts may be symmetrically formed with respect to the virtual plane. In other words, the first and second engagement parts may be symmetrically formed with respect to the same position in the direction of the second rotation axis. With such a structure, the ring member which can rotate in engagement with the flywheel and the driver in a stable attitude can be easily formed.

According to an aspect of the present invention, the ring member may have a larger diameter than the flywheel.

According to an aspect of the present invention, the holding mechanism may include a support member, a biasing member and a stopper. The support, member may be configured to rotatably support the ring member. The biasing member may be configured to bias the ring member supported by the support member toward the outer periphery of the flywheel. The stopper may be configured to hold the ring member at the separate position against a biasing force of the biasing member.

According to an aspect of the present invention, the driver moving mechanism may include an operating member and an actuator. The operating member may be disposed to be movable between a first position and a second position. The operating member may be apart from the driver in the first position. The operating member may be in contact with the driver in the second position. The actuator may be configured to move the operating member from the first position to the second position. The operating member may be configured to push the driver from the initial position toward the transmitting position when the operating member is moved from the first position to the second position by the actuator.

According to an aspect of the present invention, the restricting past may include a contact member and a biasing member. The contact member may be configured to come in contact with the driver. The biasing member may be configured to bias the driver toward the flywheel via the contact member in the facing direction.

According to an aspect of the present invention, the contact surface of the driver may include a specific section configured to come in contact with the contact member when the driver moves from a striking position to the driving position. Here, the striking position is a position in which the driver strikes the fastener. The section of the contact region may be a section of a region of the driver that corresponds to the specific section of the contact surface.

DETAILED DESCRIPTION OF THE EMBODIMENTS

An embodiment of the present invention is now described with, reference to the drawings. In this embodiment, an electric nailer 1 is explained as an example of a driving tool. The nailer 1 is a tool that is configured to perform a nailing operation of driving a nail 101 into a workpiece 100 (such as wood) by linearly driving out the nail 101.

Figure 1:
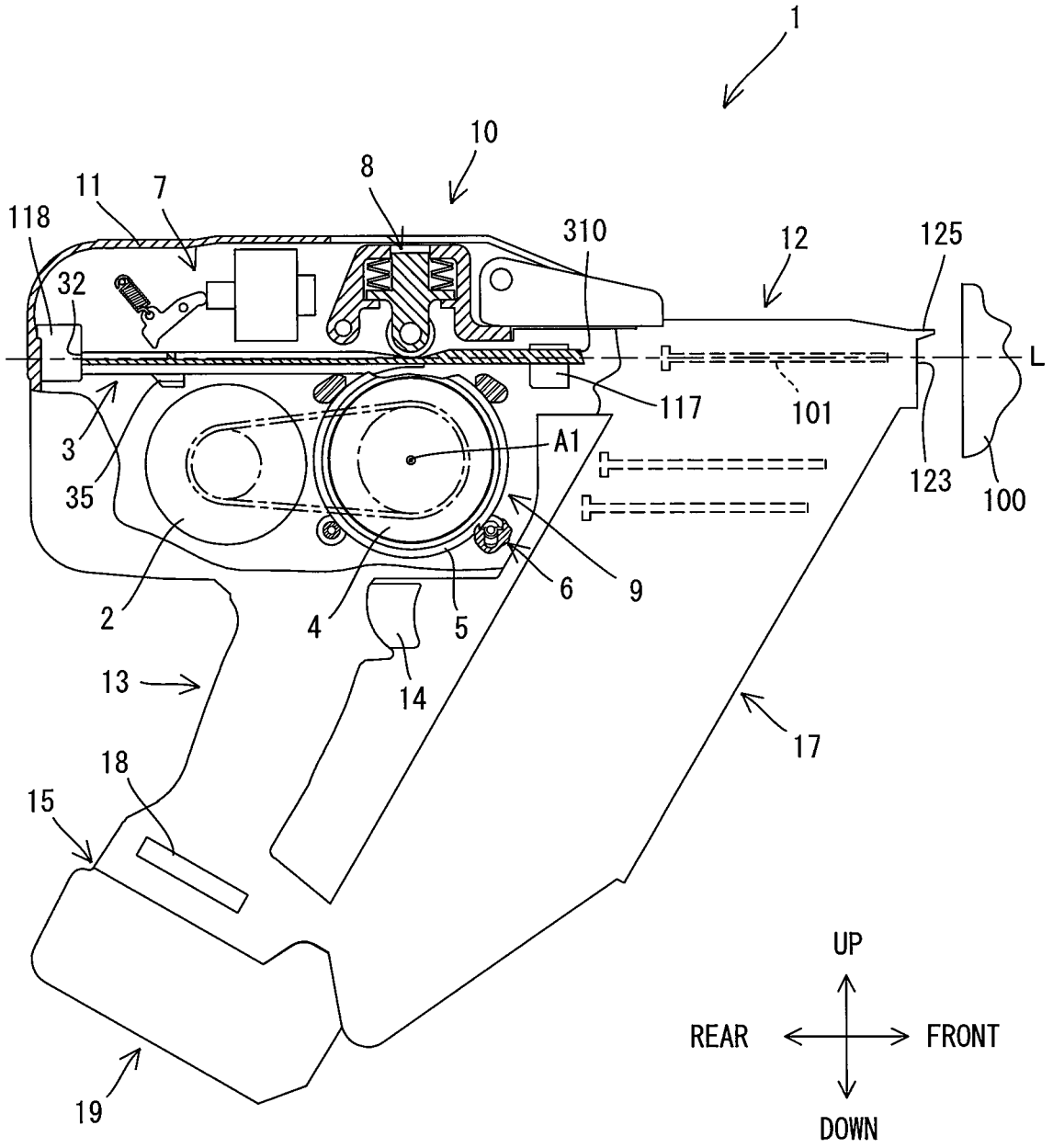
FIG. 1 is an explanatory view showing the overall structure of a nailer, with a driver in an initial position.

First, the structure of the nailer 1 is briefly explained with reference to FIG. 1. As shown in FIG. 1, the nailer 1 mainly includes a body 10, a nose 12, a handle 13 and a magazine 17.

The body 10 includes a housing 11, a driver 3, a driver driving mechanism 9 and a return mechanism (not shown). The housing 11 forms an outer shell of the body 10 and houses the driver 3, the driver driving mechanism 9 and the return mechanism. The driver 3 is configured to be movable along a specified movement axis L. The driver driving mechanism 9 is configured to drive the nail 101 out of the nailer 1 by moving the driver 3 along the movement axis L. The return mechanism is configured to return the driver 3 back to its initial position after the nail 101 is driven out.

The nose 12 is connected to one end of the housing 11 in an extending direction of the movement axis L (hereinafter simply referred to as a movement axis L direction) and has a driver passage (not shown) formed through the nose 12 in the movement axis L direction. One end of the driver passage is open to the inside of the housing 11 and the other end is open to the outside of the nailer 1 and forms an injection port 123 through which the nail 101 can be driven out. A contact arm 125 is provided adjacent to the injection port 123 on a front end of the nose 12 and configured such that it can protrude and retract in the movement axis L direction. The contact arm 125 is electrically connected to a contact arm switch (not shown).

The handle 13 extends in a direction crossing the movement axis L from a central part of the housing 11 in the movement axis L direction. The handle 13 is configured to be held by a user. A trigger 14 that may be depressed by a user is provided in a base end (an end connected to the housing 11) of the handle 13. The trigger 14 is electrically connected to a trigger switch (not shown). A battery mounting part 15 having terminals is provided on a distal end (opposite from the base end) of the handle 13. A battery 19 is removably mounted to the battery mounting part 15. A controller 18 for controlling the driver driving mechanism 9 and other components are disposed within the handle 13. The contact arm switch and the trigger switch which are described above and a motor 2 and a solenoid 715 which are described below are electrically connected to the controller 18.

The magazine 17 is configured to be loadable with a plurality of nails 101 and mounted to the nose 12. The nails 101 in the magazine 17 are fed one by one into the driver passage by a nail feeding mechanism (not shown).

In the following description, for the sake of convenience, the movement, axis L direction of the driver 3 (right-left direction as viewed in FIG. 1) is defined as a front-rear direction of the nailer 1, and the injection port 123 side (right side as viewed in FIG. 1) is defined as a front side of the nailer 1 and the opposite side (left side as viewed in FIG. 1) as a rear side. Further, a direction (an up-down direction as viewed in FIG. 1) perpendicularly crossing the movement axis L direction and corresponding to the extending direction of the handle 13 is defined as an up-down direction of the nailer 1, and the side (upper side as viewed in FIG. 1) on which the handle 13 is connected to the body 10 (the housing 11) is defined as an upper side and the side of the distal end of the handle 13 (the end on which the battery 19 is mounted) as a lower side.

Figure 4:
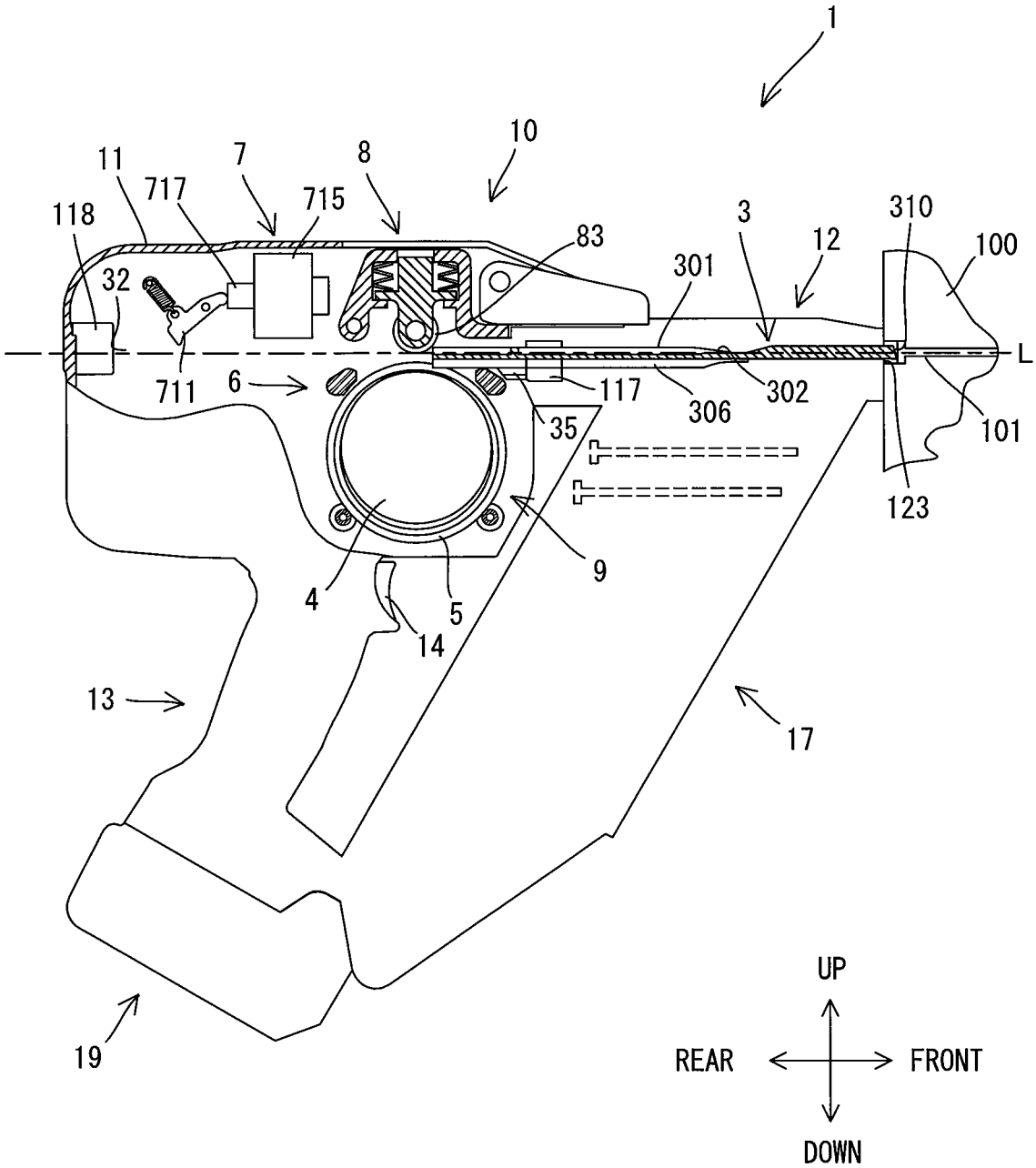
FIG. 4 is an explanatory view showing the overall structure of the nailer, with the driver in a driving position.
Figure 5:
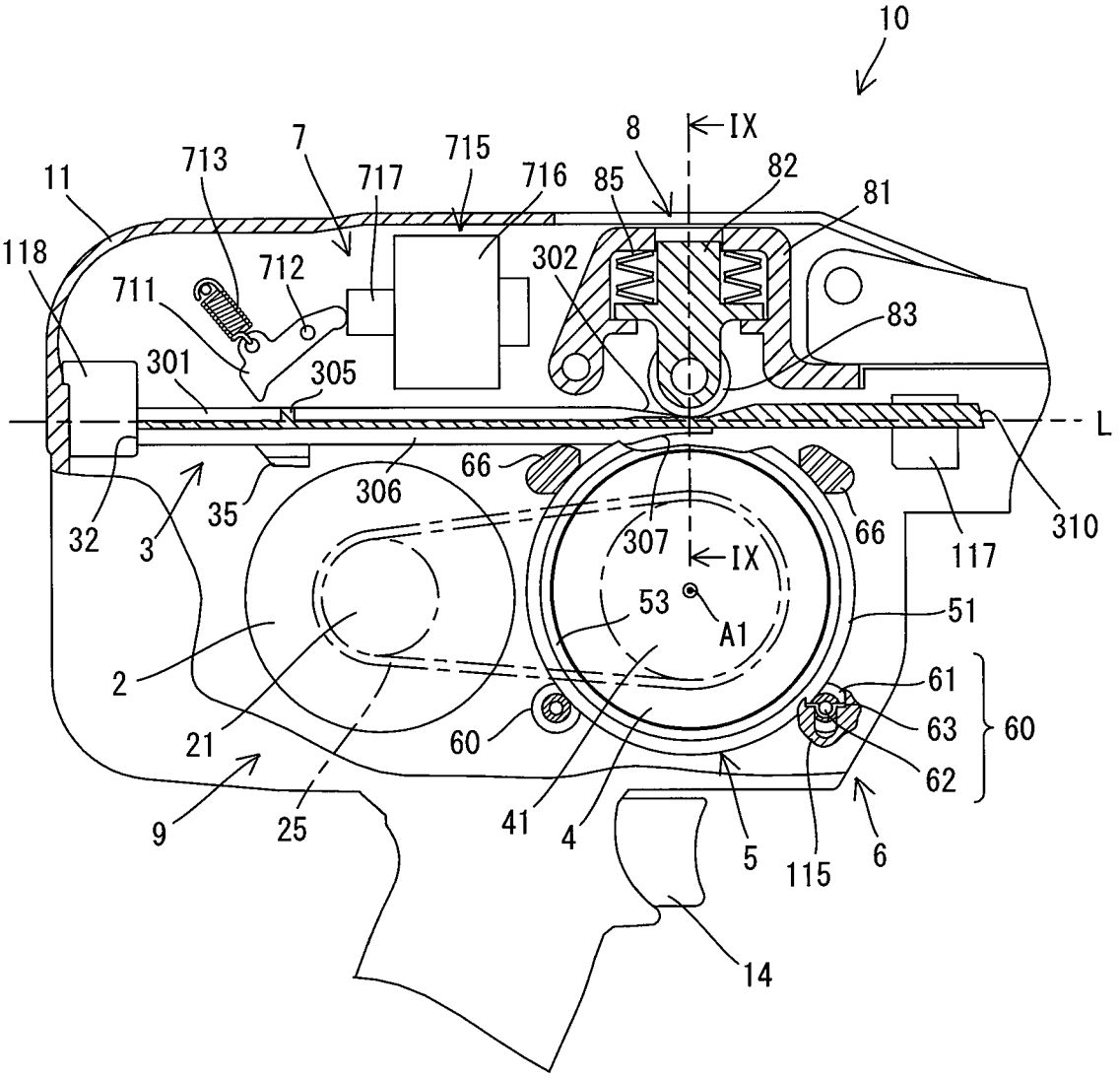
FIG. 5 is an enlarged view of a body shown in FIG. 1.

The internal structure of the body 10 is now described in detail with, reference to FIGS. 1 to 13. In FIGS. 1 and 5, for the sake of convenience of explanation, a ring member 5 which is described below is shown partly cutaway.

Figure 2:
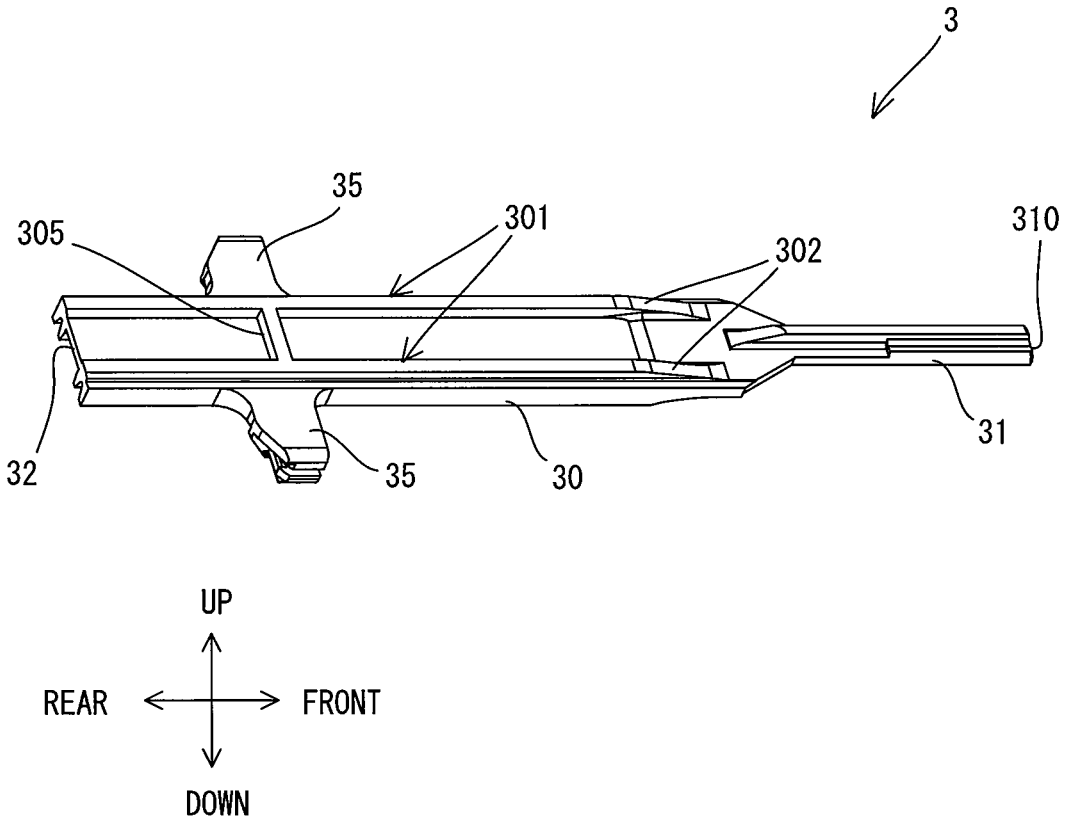
FIG. 2 is a perspective view showing the driver as viewed from above.
Figure 3:
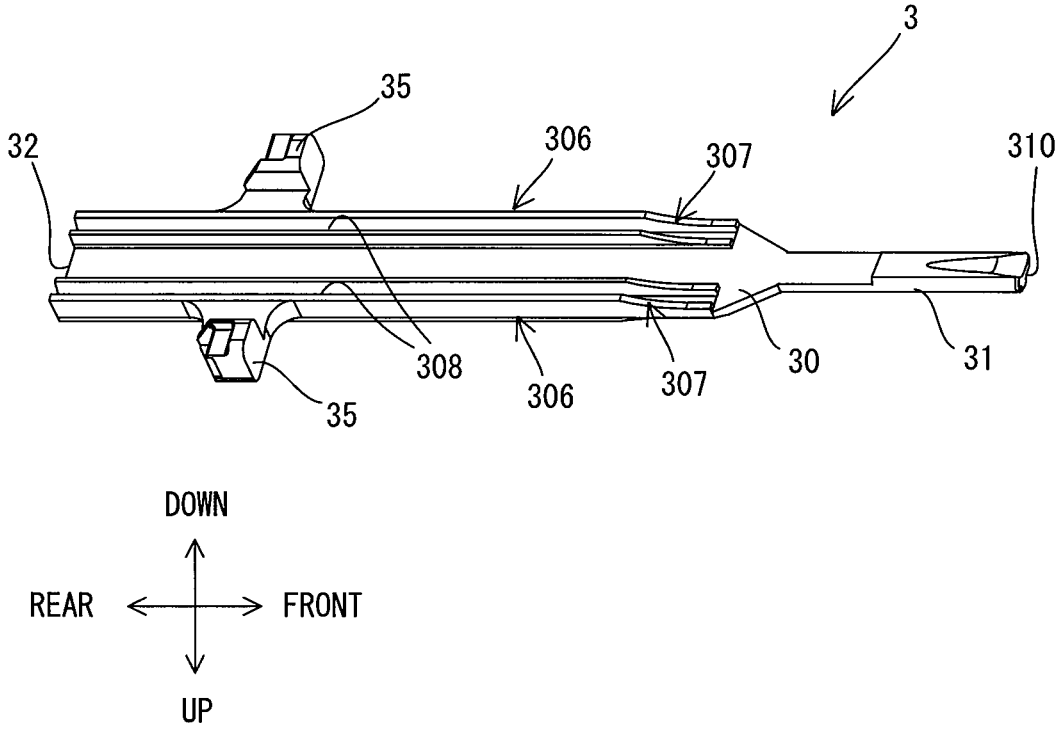
FIG. 3 is a perspective view showing the driver as viewed from below.

First, the structure of the driver 3 is described in detail with reference to FIGS. 2 and 3. As shown in FIGS. 2 and 3, the driver 3 is an elongate member formed symmetrically with respect to its longitudinal axis. The driver 3 includes a body 30 having a substantially rectangular plate-like shape as a whole, and a striking part 31 having a smaller width in a right-left direction than the body 30 and extending forward from the front end of the body 30, and a pair of arms 35 protruding to the right and the left from a rear part of the body 30.

The body 30 may be pressed by pressing rollers 83 (see FIG. 5) which are described below, and may be frictionally engaged with the ring members 5. The body 30 has a pair of roller contact parts 301, a lever contact part 305, and a pair of ring engagement parts 306. These components are now explained below.

The pair of roller contact parts 301 are integrally formed with the body 30, protruding upward from an upper surface of the body 30 and extending in the front-rear direction along right and left edge ends of the body 30. A surface on the protruding end (upper end) of the roller contact part 301 is formed as a contact surface to come in contact with an outer peripheral surface of the pressing roller 83. Further, a front end part of the roller contact part 301 is formed as an inclined part 302 which has a height (thickness in the up-down direction) increasing toward the rear. The contact surface of the inclined part 302 may have a straight shape in its entirety or a gently curved shape at least in part in side view. Specifically, the contact surface of the inclined part 302 may be flat or curved in its entirety or in part. Further, the inclination of the inclined part 302 may vary along its length. On the other hand, a rear part of the inclined part 302 of the roller contact part 301 has a constant height. The lever contact part 305 protrudes upward from the upper surface of the body 30 and extends in the right-left direction in such a manner as to connect the right and left roller contact parts 301 in the rear part of the body 30. The lever contact part 305 is configured to receive a lever 711 which is described below that comes in contact with the lever contact part 305 from the rear.

The pair of ring engagement parts 306 are integrally formal with the body 30, protruding downward from a lower surface of the body 30 and extending in the front-rear direction along the right and left edge ends of the body 30. A front end part of the ring engagement part 306 is formed as an inclined part 307 which has a height (thickness in the up-down direction) increasing toward the rear. Like the inclined part 302, a lower surface of the inclined part 307 may have a straight shape in its entirety or a gently curved shape at least in part, as viewed from the side. Further, the inclination of the inclined part 307 may vary along its length. The ring engagement parts 306 have engagement grooves 308 which are configured to be engageable with respective outer peripheral engagement parts 51 of two ring members 5 which are described below. Each of the engagement grooves 308 is recessed upward from the protruding end (lower end) of the ring engagement part 306 and extends over the whole length of the ring engagement part 306 in the front-rear direction. The engagement groove 308 is formed to have a width in the right-left direction that decreases toward the top (in other words, wall surfaces of the ring engagement part 306 in the right-left direction which define the engagement groove 308 come closer to each other toward the top) (see FIG. 10). Engagement of the driver 3 and the ring member 5 will be described below in further detail.

A rear end 32 of the body 30 defines a rear end of the driver 3. The rear end 32 is configured to prevent the driver 3 from further moving rearward by contact with a rear stopper 118 (see FIG. 1) fixed within a rear end part of the housing 11. A front end 310 of the striking part 31 defines a front end of the driver 3. The front end 310 is configured to strike a head of the nail 101 (see FIG. 1) and drive out the nail 101 forward and into a workpiece 100.

The pair of arms 35 are formed substantially at the same position as the lever contact part 305 in the front-rear direction of the driver 3 and protrude to the right and left of the body 30. The arms 35 are configured to prevent the driver 3 from further moving forward by contact with a pair of front stoppers 117 (see FIG. 1) fixed within a front end part of the housing 11. Although not described in detail and shown, the arms 35 are connected to the return mechanism by a connecting member. In the nailer 1 of this embodiment, the return mechanism may have any known structure. For example, the return mechanism may be configured to return the driver 3 from a forward driving position back to the initial position along the movement axis L by an elastic force of the compression coil spring via the connecting member.

The driver 3 having the above-described structure is disposed such that its longitudinal axis aligns with the movement axis L and extends in the front-rear direction of the nailer 1. Further, the driver 3 is held to be movable between the initial position and the driving position along the movement axis L (in other words, in the front-rear direction of the nailer 1 or in the longitudinal direction of the driver 3).

The initial position and the driving position of the driver 3 are now explained with reference to FIGS. 1 and 4. The initial position is a position in which the driver 3 is held in an unactuated state of the driver driving mechanism 9 (hereinafter referred to as initial state). In this embodiment, as shown in FIG. 1, the initial position of the driver 3 is a position where the rear end 32 of the driver 3 is in contact with the rear stopper 118. The driving position is a position where the driver 3 has been moved forward by the driver driving mechanism 9 and drives the nail 101 into a workpiece. In this embodiment, as shown in FIG. 4, the driving position of the driver 3 is a position where the front end 310 of the driver 3 slightly protrudes from the injection port 123. The driving position is also a position where the front ends of the arms 35 are in contact with the front stoppers 117 from the rear. With the above-described arrangement, in this embodiment, the initial position and the driving position of the driver 3 can also be referred to as positions that define both ends of the travel range of the driver 3 which moves along the movement axis L. Further, the front stoppers 117 and the rear stopper 118 are formed of a cushioning material in order to absorb impact caused by collision with the driver 3.

The structure of the driver driving mechanism 9 is now described in detail with reference to FIGS. 5 to 13. In this embodiment, the driver driving mechanism 9 includes a motor 2, a flywheel 4, two ring members 5, a holding mechanism 6, an actuating mechanism 7 and a pressing mechanism 8. The structures of these components are now explained in detail.

The motor 2 is explained with reference to FIG. 5. The motor 2 as a driving source is disposed within the housing 11 such that a rotation axis of an output shaft of the motor 2 extends in the right-left direction perpendicularly to the movement axis L. In this embodiment, a DC motor which is driven by using the battery 19 as a power source is used as the motor 2. A pulley 21 is connected to the output shaft of the motor 2 and rotates together with the output shaft. In this embodiment, when the contact arm 125 (see FIG. 1) of the nose 12 is pressed against the workpiece 100 and the contact arm switch is turned on, the controller 18 supplies current from the battery 19 to the motor 2 to start driving the motor 2.

The flywheel 4 is explained with reference to FIGS. 5 and 7. The flywheel 4 has a cylindrical shape. As shown in FIG. 5, the flywheel 4 is rotatably supported in front of the motor 2 within the housing 11 via a support shaft (not shown) which is inserted through a through hole 40 (see FIG. 7) and fixed. The flywheel 4 may be rotationally driven around a rotation axis A1 by the motor 2. The rotation axis A1 extends in parallel to a rotation axis of the motor 2 in the right-left direction perpendicular to the movement axis L of the driver 3. A pulley 41 is connected to the support shaft of the flywheel 4 and rotates together with the support shaft and the flywheel 4. A belt 25 is looped over the pulley 21 and the pulley 41. When the motor 2 is driven, rotation of the motor 2 is transmitted to the flywheel 4 via the belt 25 and the flywheel 4 rotates clockwise as viewed in FIG. 5.

Figure 7:
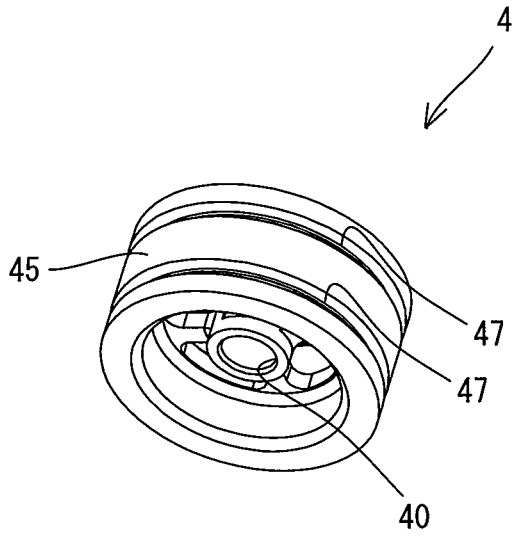
FIG. 7 is a perspective view showing the flywheel.

As shown in FIG. 7, an outer periphery 45 of the flywheel 4 has a pair of engagement grooves 47 which are configured to be engageable with inner periphery engagement parts 53 of the respective two ring members 5 which are described below. The pair of engagement grooves 47 are spaced apart from each other in the direction of the rotation axis A1 (right-left direction) and recessed radially inward (toward the rotation axis A1) and extend over the whole circumference of the flywheel 4. Further, each of the engagement grooves 47 is formed such that the width in the right-left direction decreases toward the inside in the radial direction (in other words, wall surfaces of the engagement groove 47 in the right-left direction which define the engagement groove 47 come closer to each other toward the inside in the radial direction) (see FIG. 10). Engagement of the flywheel 4 and the ring member 5 will be described below in further detail.

Figure 6:
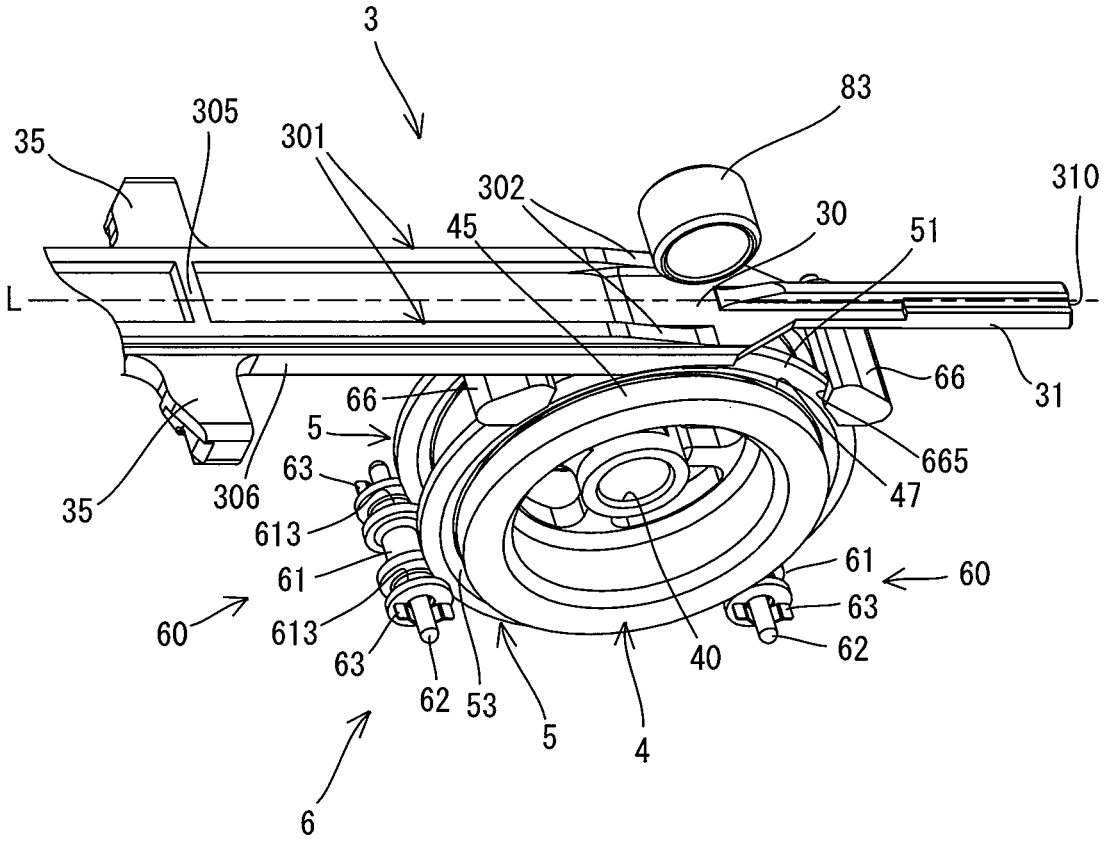
FIG. 6 is a perspective view showing a flywheel, a ring member, a holding mechanism and a pressing roller, with the driver in the initial position.

The two ring members 5 are explained with reference to FIGS. 6, 8 to 10. As shown in FIG. 6, each of the ring members 5 has a ring-like shape having a larger diameter than the flywheel 4. In this embodiment, the inner diameter of the ring member 5 is set to be larger than the outer diameter of the flywheel 4 (more accurately, when the radius is takers as a distance from the rotation axis A1 of the flywheel 4 to the bottom of the engagement groove 47). The two ring members 5 are spaced apart from each other in the right-left direction, corresponding to the pair of engagement grooves 47 of the flywheel 4, and disposed radially outside the flywheel 4. In this embodiment, the ring members 5 are held by a holding mechanism 6, which is described below, so as to be movable between a separate position, in which the ring members 5 are each held apart from the outer periphery 45 (more specifically, from the engagement grooves 47) of the flywheel 4, and a contact position, in which the ring members 5 are each, held in partial contact with the outer periphery 45 (more specifically, with the engagement grooves 47).

Figure 8:
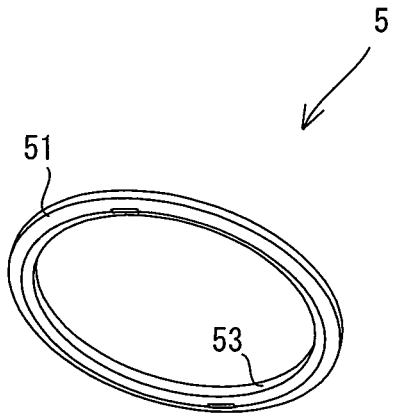
FIG. 8 is a perspective view showing the ring member.
Figure 9:
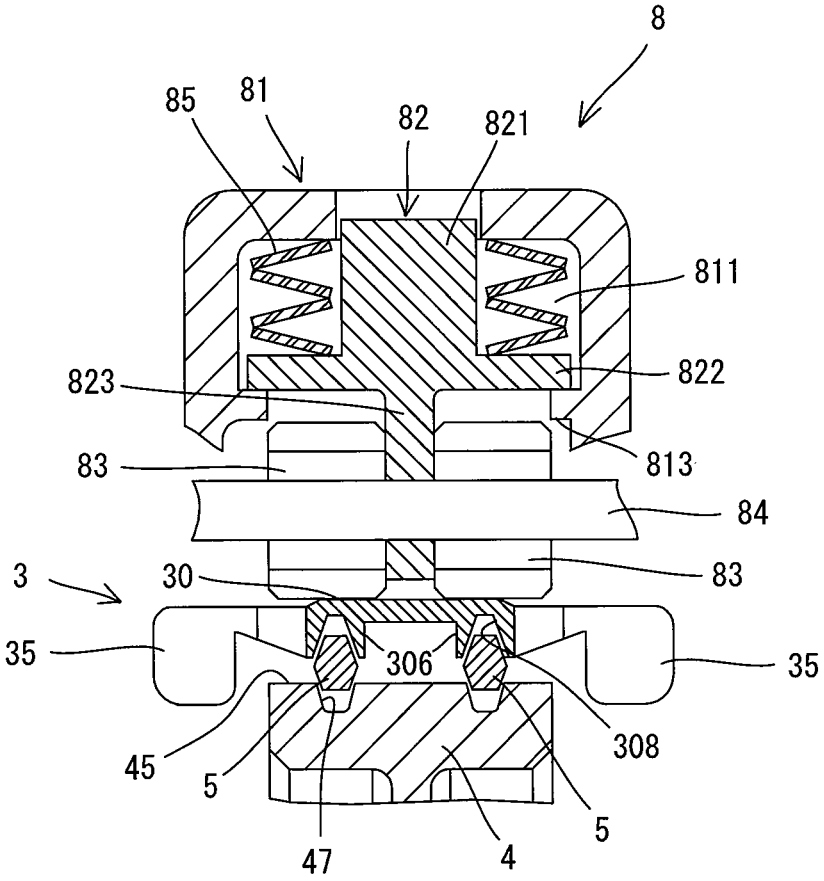
FIG. 9 is a sectional view taken along line IX-IX in FIG. 2.

Each of the ring members 5 is configured to transmit the Rotational energy of the flywheel 4 to the driver 3 and configured to be frictionally engaged with the driver 3 and the flywheel 4. Specifically, as shown in FIGS. 8 to 10, the outer periphery engagement part 51 and the inner periphery engagement part 53 are respectively formed in outer and inner peripheries of the ring member 5 and configured to engage with the engagement groove 308 of the driver 3 and the engagement groove 47 of the flywheel 4.

Figure 10:
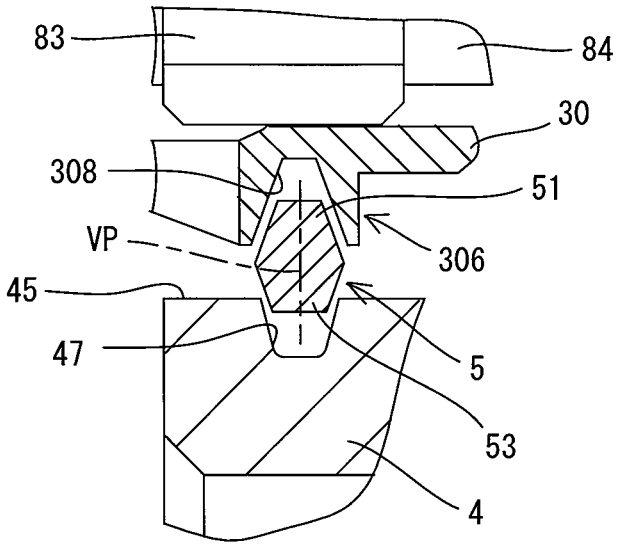
FIG. 10 is an enlarged view showing one of the ring members and its peripheral part in FIG. 9.

As shown in FIG. 10, the outer periphery engagement part 51 is formed as a projection protruding outward in the radial direction of the ring member 5, and the inner periphery engagement part 53 is formed as a projection protruding inward in the radial direction of the ring member 5. The ring member 5 has a generally hexagonal shape when a cross-section is taken along the radial direction. The outer periphery engagement part 51 is formed to have a thickness in the axial direction of the ring member 5 which decreases toward the outside in the radial direction of the ring member 5, and the inner periphery engagement part 53 is formed to have a thickness in the axial direction of the ring member 5 which decreases toward the inside in the radial direction of the ring member 5. Further, in this embodiment, both the outer periphery engagement part 51 and the inner periphery engagement part 53 are symmetrically formed with respect to a virtual plane VP that is perpendicular to a rotation axis A2 (see FIG. 14) of the ring member 5. In other words, both the outer periphery engagement part 51 and the inner periphery engagement part 53 are funned as projections having the same center axis in the direction of the rotation axis A2. Engagement of the ring member 5 with the driver 3 and the flywheel 4 will be described below in further detail.

The holding mechanism 6 is explained with reference to FIGS. 5, 6, 11 to 13. As described above, the holding mechanism 6 is configured to hold the ring members 5 such that the ring members 5 can move between the separate position and the contact position. As shown in FIGS. 5 and 6, the holding mechanism 6 of this embodiment includes a pair of ring biasing parts 60 and a pair of stoppers 66.

The pair of ring biasing parts 60 are configured to support the ring members 5 while biasing the ring members 5 upward from below. In this embodiment, the ring biasing parts 60 are respectively disposed diagonally forward and downward of the ring members 5 and diagonally rearward and downward of the ring members 5. Each of the ring biasing parts 60 includes a support member 61, a support shaft 62 and a pair of flat springs 63.

Figure 11:
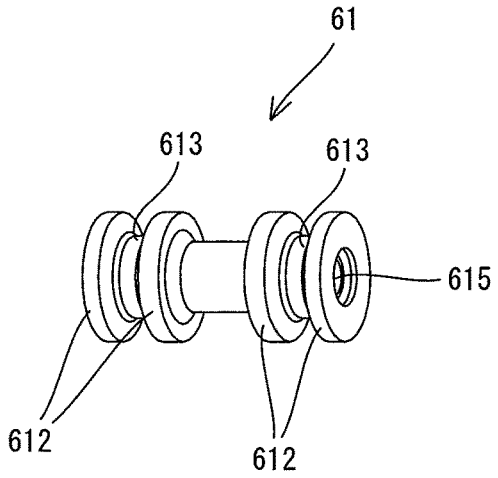
FIG. 11 is a perspective view showing a support member.
Figure 12:
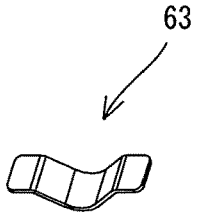
FIG. 12 is a perspective view showing a flat spring.

As shown in FIG. 11, the support member 61 has a cylindrical shape having an axially extending through hole 615. A pair of support grooves 613 for rotatably supporting the ring members 5 are formed in both axial end parts of the support member 61 and over the whole circumference. In this embodiment, each of the support grooves 613 is formed as a clearance between a pair of flanges 612 which protrude in a radially outward direction of the support member 61. As shown in FIG. 6, the support shaft 62 is inserted through the through hole 615 of the support member 61 and fixed to the support member 61 with the both ends of the support shaft 62 protruding from the both ends of the through hole 615. As shown in FIG. 12, each of the flat springs 63 is substantially U-shaped as a whole.

As shown in FIG. 5, each of the ring biasing parts 60 is disposed such that the support shaft 62 extend in the right-left direction, and the both ends of the support shaft 62 are supported via the flat springs 63 by a support 115 (only a front one is shown) which are fixed in the housing 11.

Figure 13:
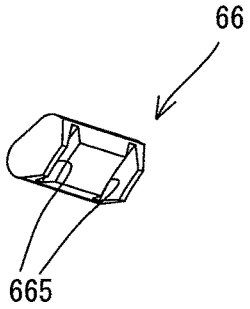
FIG. 13 is a perspective view showing a stopper.

The pair of stoppers 66 are configured to prevent the ring members 5 from further moving upward. As shown in FIG. 13, each of the stoppers 66 has a pair of guide grooves 665. Each of the guide grooves 665 is configured such that the outer periphery engagement part 51 of the ring member 5 can slide in the guide groove 665. As shown in FIG. 6, the stoppers 66 are disposed below the driver 3 and respectively diagonally forward and upward of the ring members 5 and diagonally rearward and upward of the ring members 5 such that the guide grooves 665 face the outer periphery engagement parts 51.

Holding the ring members 5 by the holding mechanism 6 in the initial state is now explained with reference to FIGS. 6, 9 and 10. As shown in FIG. 6, each of the outer periphery engagement parts 51 of the ring members 5, which is disposed radially outside the flywheel 4, is engaged in one of the support grooves 613 of each of the support members 61. The flat springs 63 supported by the support 115 (see FIG. 5) bias the ring members 5 upward via the support shaft 62 and the support member 61. Meanwhile, the pair of stoppers 66 prevent the ring members 5 from further moving upward by contact with the outer periphery engagement parts 51 of the ring members 5 respectively from diagonally forward and upward and from diagonally rearward and upward. Thus, the ring members 5 are held at the separate position apart from the outer periphery 45 of the flywheel 4. More specifically, as shown in FIGS. 9 and 10, each of the ring members 5 is held at a position in which the inner periphery engagement part 53 is slightly apart from the engagement groove 47 of the flywheel 4. It is noted that only an upper end part of the flywheel 4 is shown in the drawings. Similarly, however, the ring member 5 is apart from the outer periphery 45 (more specifically, the engagement groove 47) of the flywheel 4 over its whole circumference.

The actuating mechanism 7 is explained with reference to FIG. 5. The actuating mechanism 7 is disposed above the driver 3 and rearward of the flywheel 4 within the housing 11. The actuating mechanism 7 is configured to move the driver 3 from the initial position to a transmitting position which is described below. In this embodiment, the actuating mechanism 7 mainly includes a lever 711 and a solenoid 715.

The lever 711 is disposed to be rotatable on a pin 712 extending in the right-left direction. The solenoid 715 is disposed in front of the lever 711 and has an operating part 717 which protrudes rearward from a frame 716 and configured to protrude and retract in the front-rear direction. In the initial state, a front end of the lever 711 is held in contact with a rear end of the operating part 717, and a rear end of the lever 711 is held in such a manner as to be biased upward and rearward by a tension coil spring 713. At this time, the rear end of the lever 711 is located above the driver 3 and rearward of a lever contact part 305 of the driver 3.

In this embodiment, when the contact arm switch (not shown) of the contact arm 125 (see FIG. 1) is turned on and the trigger 14 is depressed to turn on the trigger switch (not shown), the controller 18 (see FIG. 1) supplies current to the solenoid 715. Then, the operating part 717 is caused to protrude rearward and pushes the front end of the lever 711 rearward. As a result, the lever 711 rotates on the pin 712 and the rear end of the lever 711 pushes the lever contact part 305 of the driver 3 forward from the rear, so that the driver 3 is moved forward. Operation of the driver 3 and the driver driving mechanism 9 will be described below in further detail.

The pressing mechanism 8 is explained with reference to FIGS. 5 and 9. As shown in FIG. 5, the pressing mechanism 8 is disposed within the housing 11 above the driver 3 so as to face the flywheel 4 across the driver 3. The pressing mechanism 8 is configured to restrict a movement (an upward movement) of the driver 3 in a direction away from the flywheel 4. Further, the pressing mechanism 8 is configured to press down the driver 3 toward the ring members 5 in a process in which the driver 3 moves forward from the initial position. In this embodiment, the pressing mechanism 8 mainly includes a frame 81, a roller holding part 82, a pair of pressing rollers 83 and disc springs 85.

As shown in FIG. 9, the frame 81 has a hollow shape having a housing space 811 which can house a part of the roller holding part 82 and the disc springs 85, and the frame 81 is fixed within the housing 11 (see FIG. 5). The right and left pressing rollers 83 are rotatably supported via a roller support shaft 84 on a lower end part 823 of the roller holding part 82. An upper part 821 of the roller holding part 82 is cylindrical, and a spring receiving part 822 is formed on a lower end of the upper part 821 and protrudes in a radially outward direction of the upper part 821. The upper part 821 is housed in the housing space 811 of the frame 81 with the disc springs 85 disposed around the outer periphery of the upper part 821. An upper end of the disc springs 85 is held in contact with a lower surface of an upper wall of the frame 81 and a lower end of the disc springs 85 is held in contact with an upper surface of the spring receiving part 822. The frame 81 has a locking part 813 protruding radially inward into the housing space 811. In the initial state, the spring receiving part 822 is biased downward by the disc springs 85 and held in contact with the locking part 813 from above, so that the spring receiving part 822 is prevented from further moving downward and held in the lowermost position.

Operation of the nailer 1 having the above-described structure, or more specifically, positional change of the driver 3 and operation of the driver driving mechanism 9 associated with the change (particularly, change of engagement of the ring members 5 with the driver 3 and with the flywheel 4) are now explained with reference to FIGS. 1, 4, 5, 9, 10, and 14 to 19.

As described above, in the initial state of the nailer 1, the driver 3 is located in the initial position shown in FIGS. 1 and 5. At this time, as shown in FIGS. 9 and 10, each of the ring members 5 is held by the holding mechanism 6 at the separate position slightly apart from the outer periphery 45 (more specifically, from the engagement groove 47) of the flywheel 4 in a radially outward direction. Further, at this time, each of the pressing rollers 83 is held at the lowermost position and in sliding contact with the front end part of the body 30 of the driver 3 from above, but not yet pressing the driver 3 downward. In this state, the ring members 5 are held apart not only from the flywheel 4 but also from the driver 3. More specifically, each of the ring members 5 is held at a position in which the outer periphery engagement part 51 is slightly separated apart downward from the engagement groove 308 of the driver 3.

In a state in which the driver 3 is placed in the initial position shown in FIGS. 1 and 5, the contact arm 125 on the front end of the nose 12 is pressed against the workpiece 100 and the contact arm switch (not shown) is turned on. Then, the motor 2 is driven and the flywheel 4 starts rotating. At this stage, however, the ring members 5 are each held at the separate position and not capable of transmitting the rotational energy of the flywheel 4 to the driver 3. Therefore, even if the flywheel 4 rotates, the ring members 5 and the driver 3 do not operate. In other words, the ring members 5 and the driver 3 are in a stationary state.

Thereafter, when the user depresses the trigger 14 and the trigger switch (not shown) is turned on, the solenoid 715 is actuated. Then, the lever 711 is caused to rotate and the rear end of the lever 711 pushes the lever contact part 305 of the driver 3 forward from the rear. Thus, the driver 3 starts moving forward from the initial position toward the driving position along the movement axis L. The driver 3 also moves with respect to the ring members 5 held at the separate position.

The pressing rollers 83 come in contact, from the front, with the respective contact surfaces of the inclined parts 302, each having a thickness increasing toward the rear. As the inclined part 302 moves forward while being pressed by the pressing roller 83, a part of the outer periphery engagement part 51 of the ring member 5 enters the corresponding engagement groove 308 (see FIG. 3) of the driver 3 and comes in contact with opening edges of the engagement groove 308. Further, with the structure in which the front end part of the ring engagement part 306 has the inclined part 307 and the width of the engagement groove 308 in the right-left direction is wider on the opening edge side, the outer periphery engagement part 51 can smoothly enter the engagement groove 308. In this state in which the pressing rollers 83 ore in contact with the contact surfaces of the inclined parts 302 and a part of each outer periphery engagement part 51 is in contact with the opening edges of the engagement groove 308, when the driver 3 is further moved forward, the inclined parts 302 function as a cam and further exhibit a wedge effect. Therefore, the ring members 5 are pushed downward from the separate position against the biasing force of the flat springs 63, and the pressing rollers 83 are pushed upward from the lowermost position against the biasing force of the disc springs 85.

Figure 14:
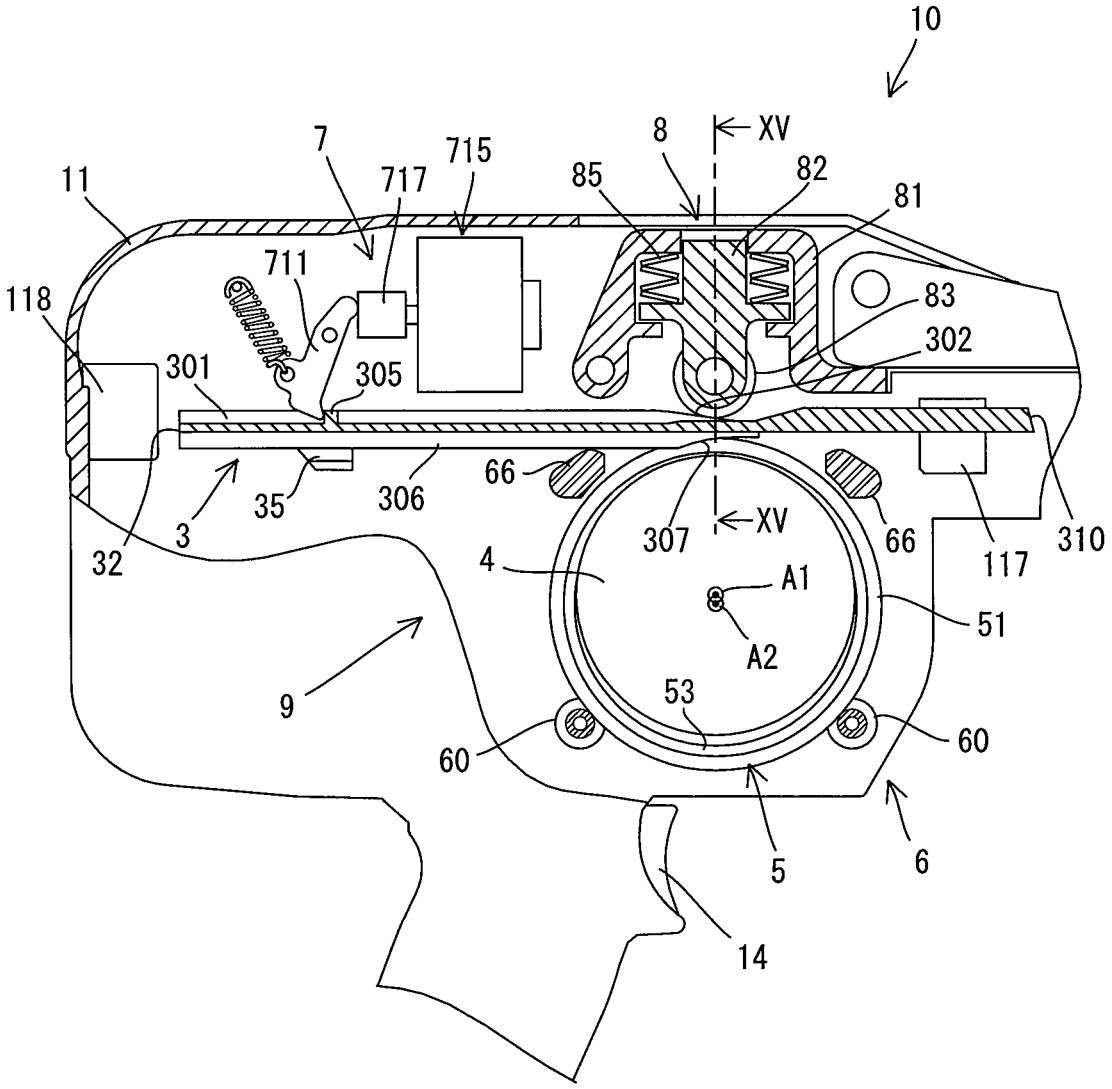
FIG. 14 is an explanatory view showing the driver in a transmitting position and a driver driving mechanism.

While the driver 3 moves to the transmitting position shown in FIG. 14, a part of the inner periphery engagement part 53 of each of the ring members 5 moved downward enters the corresponding engagement groove 47 (see FIG. 7) of the flywheel 4 and comes in contact with opening edges of the engagement groove 47. The ring members 5 are thus prevented from further moving downward. At this time, the ring members 5 are rotatably supported at the lowermost position by the ring biasing parts 60, while being separated from the stoppers 66. Thus, only a part of the inner periphery engagement part 53 of each ring member 5 is held in contact with the upper part of the flywheel 4. Specifically, the ring members 5 are held in the contact position by the holding mechanism 6. Further, with foe structure in which the width of the engagement groove 47 in the right-left, direction is wider on the opening edge side, the inner periphery engagement part 53 can smoothly enter the engagement groove 47.

Figure 15:
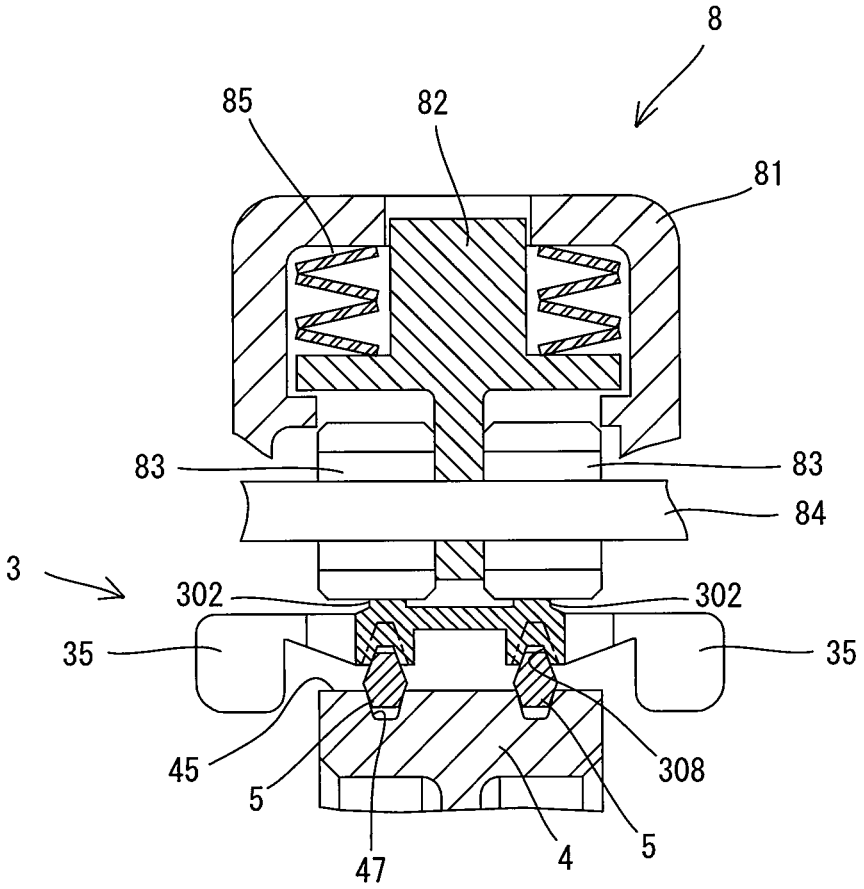
FIG. 15 is a sectional view taken along line XV-XV in FIG. 14.

Further, as shown in FIG. 15, when the pressing rollers 83 are pushed up by the inclined parts 302, the disc springs 85 are compressed, and the ring members 5 are pressed against the flywheel 4 via the driver 3 by the elastic force of the disc springs 85. Therefore, a part of the outer periphery engagement part 51 of each of the ring members 5 is held in frictional engagement with the driver 3 at the opening edges of the engagement groove 308 of the driver 3 as shown by points P1, P2 in FIG. 16. Further, a part of the inner periphery engagement part 53 of each of the ring members 5 is held in frictional engagement with the flywheel 4 at the opening edges of the engagement groove 47 of the flywheel 4 as shown by points P3, P4 in FIG. 16. As described above, both the outer periphery engagement part 51 and the inner periphery engagement part 53 are formed as projections symmetrical with respect to the virtual plane VP perpendicular to the rotation axis A2. Therefore, the points P1, P2, as well as the points P3, P4, are located equally apart from the virtual plane VP. In other words, the virtual plane VP passing a midpoint between fee points P1, P2 in the direction of the rotation axis A2 (right-left direction) also passes a midpoint between the points P3, P4 in the direction of the rotation axis A2 (right-left direction).

Thus, when the ring members 5 are held in frictional engagement with the driver 3 and with the flywheel 4, the ring members 5 are allowed to transmit the rotational energy of the flywheel 4 to the driver 3. Here, the "frictional engagement" refers to a state (including a sliding state) that two members are engaged with each other by frictional force. The ring members 5 are each rotated on the rotation axis A2 by the flywheel 4 while only a part of the inner periphery engagement part 53 of the ring member 5 which is pressed against the flywheel 4 by the driver 3 is held in frictional engagement with the flywheel 4. In this embodiment, as shown in FIG. 14, the ring member 5 has a larger diameter than the flywheel 4, and has the inner diameter that is larger than the outer diameter of the flywheel 4 (more accurately, when the radius is taken as a distance from the rotation axis A1 of the flywheel 4 to the bottom of the engagement groove 47). Therefore, the rotation axis A2 of the ring member 5 is different from the rotation axis A1 of the flywheel 4 and located below the rotation axis A1 (in a direction away from the driver 3). Further, the rotation axis A2 extends in parallel to the rotation axis A1. The driver 3 held in frictional engagement with the ring member 5 is pushed forward from the transmitting position shown in FIG. 14 by the ling member 5.

Figure 16:
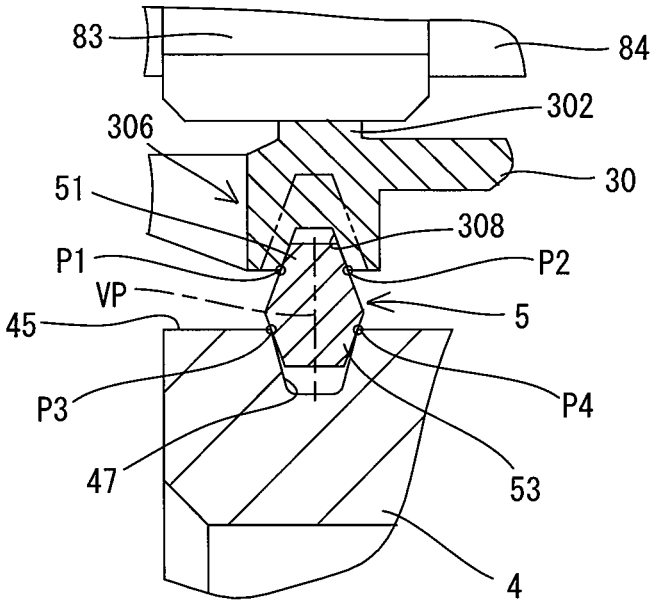
FIG. 16 is an enlarged view showing one of the ring members and its peripheral part in FIG. 15.

Further, the inner periphery engagement part 53 which is configured to engage with the flywheel 4 rotating at high speed may be more rapidly worn out, compared with the outer periphery engagement part 51 which is configured to engage with the driver 3 moving at relatively low speed. In view of this, as shown in FIG. 16, the ring member 5 is formed such that the thickness of its engagement part (a distance in the right-left direction between the points P3 and P4 of the inner periphery engagement part 53) to be engaged with the flywheel 4 is larger than the thickness of its engagement part (a distance in the right-left direction between the points P1 and P2 of the outer periphery engagement part 51) to be engaged with the driver 3. Further, in order to facilitate engagement of the ring member 5 with the flywheel 4 rotating at high speed by its wedge effect, the inclination angle of the inclined surfaces (the right and left side surfaces) of the inner periphery engagement part 53 with respect to the up-down direction is preferably set to be smaller than the inclination angle of the inclined surfaces (the right and left side surfaces) of the outer periphery engagement part 51.

Figure 17:
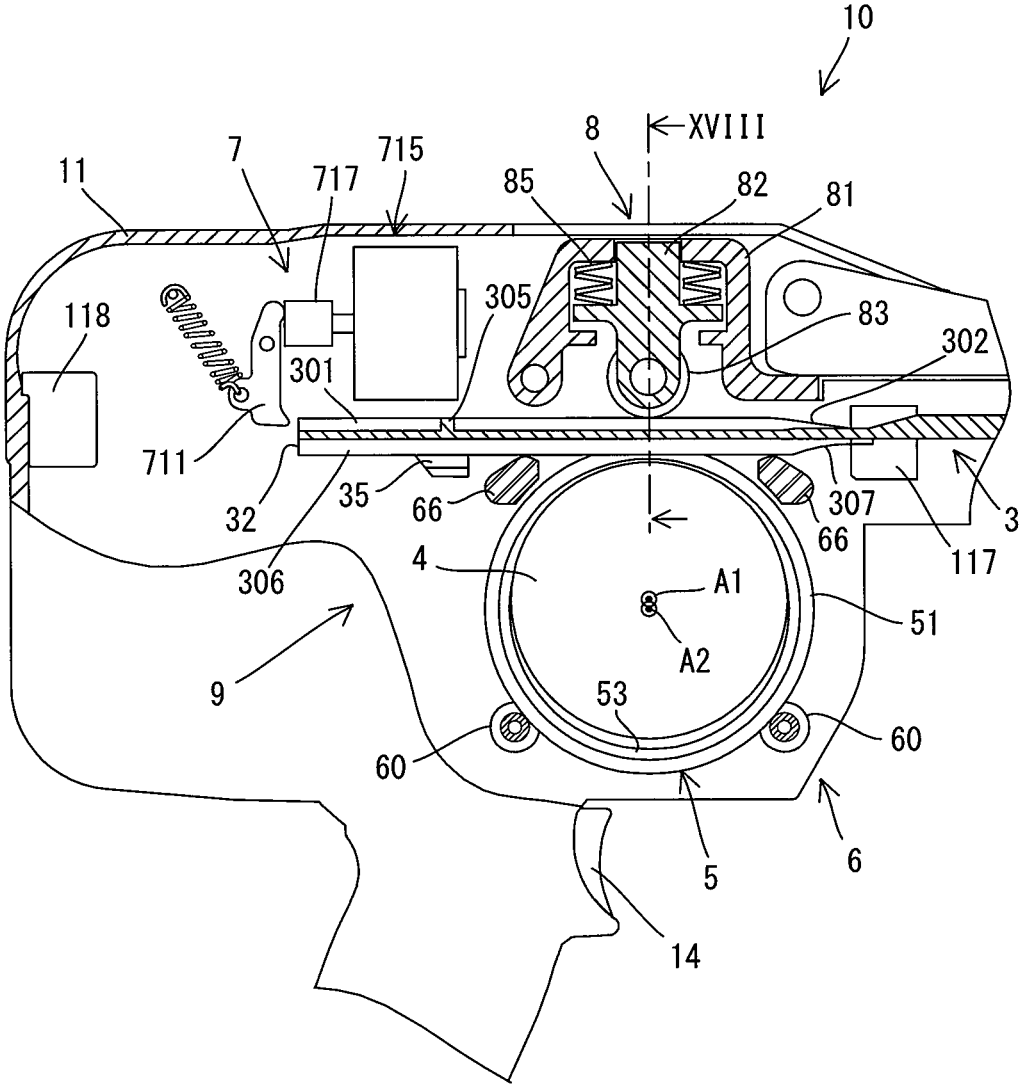
FIG. 17 is an explanatory view showing the driver in a striking position and the driver driving mechanism.
Figure 18:
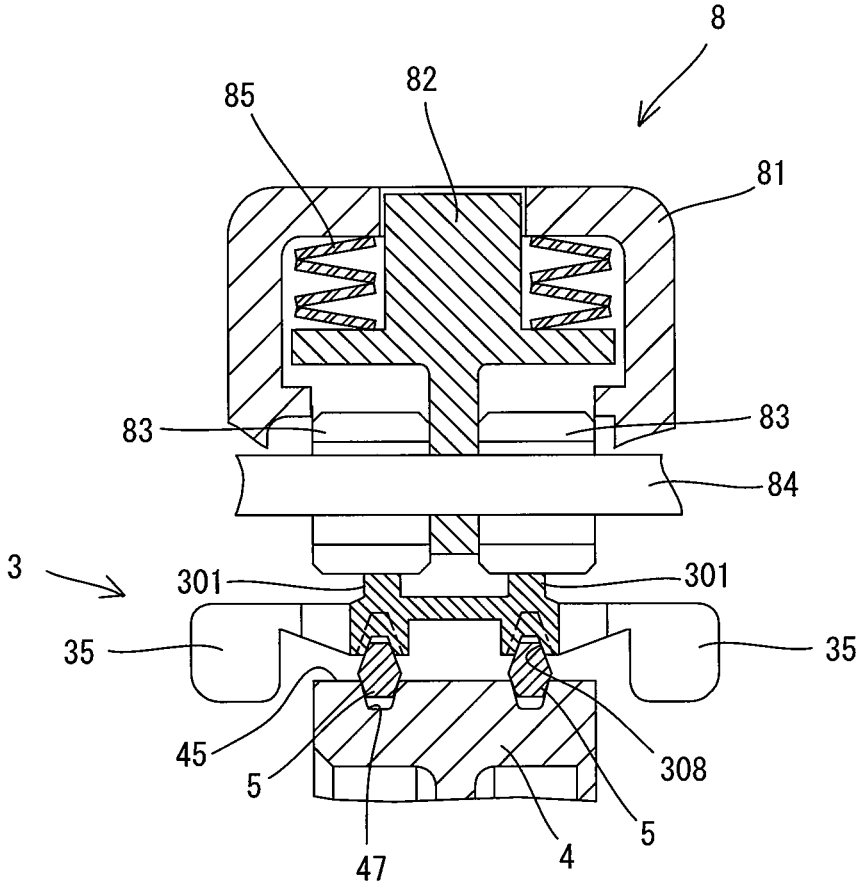
FIG. 18 is a sectional view taken along line XVIII-XVIII in FIG. 17.
Figure 19:
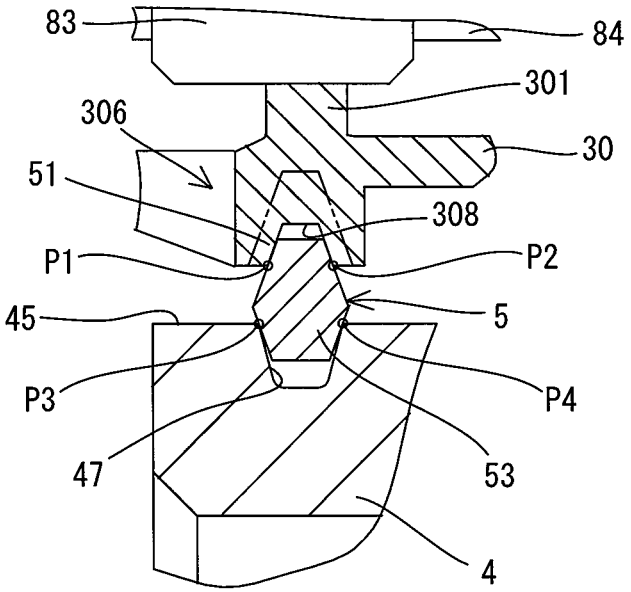
FIG. 19 is an enlarged view showing one of the ring members and its peripheral part in FIG. 18.

As shown in FIGS. 17 to 19, when the driver 3 is pushed forward from the transmitting position and the pressing rollers 83 come in contact with the respective contact surfaces of the rear parts of the inclined parts 302 in the roller contact parts 301, the pressing rollers 83 are pushed up to the uppermost position. Thus, the ring members 5 are further pressed against the flywheel 4 via the driver 3 by the elastic force of the disc springs 85. Therefore, firmer frictional engagements are established between the driver 3 and the part of the outer periphery engagement part 51 and between the flywheel 4 and the part of the inner periphery engagement part 53. Thus, each of the ring members 5 can more efficiently transmit the rotational energy of the flywheel 4 to the driver 3. Further, FIG. 17 shows the state in which the driver 3 is in a striking position of striking the nail 101 (see FIG. 1).

As shown in FIG. 4, the driver 3 is pushed forward by the ring members 5 and moved to the driving position along the movement axis L. Then the driver 3 drives the nail 101 out into the workpiece through the injection port 123. The driver 3 stops moving when the front end of the arms 35 of the driver 3 come in contact with the front stoppers 117 from the rear. Further, when a specified time required for the driver 3 to reach the driving position elapses after the trigger switch of the trigger 14 is turned on, the controller 18 stops supplying current to the solenoid 715 to thereby return the operating part 717 to the initial position. Thus, the lever 711 is also returned to the initial position. In this state, when the user releases the pressing of the contact aim 125 (see FIG. 1) against the workpiece 100, the controller 18 stops driving the motor 2. Then, the flywheel 4 stops rotating and the return mechanism (not shown) is actuated to return the driver 3 to the initial position.

As described above, the nailer 1 of this embodiment includes the driver driving mechanism 9 which is configured to move the driver 3 for driving the nail 101 into a workpiece, from the initial position to the driving position along the movement axis L. The driver driving mechanism 9 includes the flywheel 4, the ring members 5 each configured to transmit the rotational energy of the flywheel 4 to the driver 3, and the actuating mechanism 7 configured to move the driver 3 with respect to the ring members 5 from the initial position to the transmitting position in which the ring members 5 are capable of transmitting the rotational energy to the driver 3.

When the driver 3 is placed in the initial position, the ring members 5 are disposed loosely around the outer periphery 45 (more specifically, the engagement grooves 47) of the flywheel 4. Further, when the driver 3 is moved to the transmitting position by the actuating mechanism 7, the ring members 5 are each frictionally engaged with the driver 3 and with the flywheel 4 and rotated around the rotation axis A2 by the flywheel 4 and transmit the rotational energy to the driver 3 to thereby push the driver 3 forward from the transmitting position toward the driving position. Thus, the driver 3 is not directly pressed against the flywheel 4 which is rotating at high speed. Therefore, wear of the driver 3 can be reliably suppressed, and the durability of the driver 3 can be enhanced. Further, although the ring member 5 may need to be replaced when worn out, the ring member 5 is generally inexpensive compared with the driver 3. Therefore, the cost for replacement can be reduced.

Further, when transmitting the rotational energy to the driver 3, the ring members 5 rotate around the rotation axis A2 which is different from the rotation axis A1 of the flywheel 4. Therefore, the same region of the ring member 5 does not always come in contact with the flywheel 4 at the start of the transmission. Therefore, wear of only a specific region of the ring member 5 can be prevented.

Further, the nailer 1 includes the holding mechanism 6 which is configured to hold the ring members 5 such that each of the ring members 5 can move between the separate position in which the ring member 5 is held apart from the outer periphery 45 (more specifically, the engagement groove 47) of the flywheel 4 and the contact position in which the ring member 5 is held in partial contact with the outer periphery 45 (more specifically, the engagement groove 47). The holding mechanism 6 is configured to hold the ring members 5 at the separate position when the driver 3 is placed in the initial position, and to hold the ring members 5 at the contact position when the driver 3 is moved to the transmitting position by the actuating mechanism 7 and the ring members 5 are moved in response to the movement of the driver 3. Therefore, when the driver 3 is placed in the initial position, the ring members 5 are not rotated by the flywheel 4. When the driver 3 is moved to the transmitting position, the ring members 5 are accordingly moved to the contact position and rotated in partial contact with the outer periphery 45 (more specifically, the engagement grooves 47) of the flywheel 4. With the holding mechanism 6 having such a structure, the timing when the ring members 5 start rotating can be properly linked with the movement of the driver 3 to the transmitting position.

Further, in this embodiment, the transmitting position is located between the initial position and the driving position in the movement axis L direction of the driver 3. The actuating mechanism 7 is configured to push the driver 3 from the initial position toward the transmitting position along the movement axis L. Specifically, the transmitting position is located on the way when the driver 3 is moved from the initial position toward the driving position along the movement axis L, so that the driver 3 can be smoothly moved to the driving position in a series of operations.

Further, the nailer 1 includes the pressing mechanism 8 which is configured to restrict a movement of the driver 3 away from the flywheel 4 in a direction (up-down direction) in which the driver 3 and the outer periphery 45 of the flywheel 4 face each other. Further, the front end part of the body 30 (having the inclined parts 302) is formed to have a thickness in the up-down direction that increases toward the rear and configured to come in contact with the ring members 5 in the process in which the driver 3 moves from the initial position to the transmitting position. The front end part of the body 30 (the inclined parts 302) function as a cam and further exhibits a wedge effect to efficiently move the ring members 5 toward the outer periphery 45 (the engagement grooves 47) of the flywheel 4.

In this embodiment, the two ring members 5 are respectively provided corresponding to the right and left edges of the driver 3 extending in the movement axis L direction on the opposite sides of the movement axis L. Therefore, the driver 3 can be moved along the movement axis L in a stable attitude.

Further, the ring member 5 has the outer periphery engagement part 51 formed as a projection which is configured to engage with the engagement groove 308 of the driver 3 and the inner periphery engagement part 53 formed as a projection which is configured to engage with the engagement groove 47 in the outer periphery 45 of the flywheel 4. With this structure, reliable transmission of the rotational energy from the flywheel to fee driver can be secured. Particularly, both the outer periphery engagement part 51 and the inner periphery engagement part 53 are symmetrically formed with respect to the virtual plane VP that is perpendicular to the rotation axis A2 of the ring member 5. In other words, the outer periphery engagement part 51 and the inner periphery engagement part 53 are respectively engaged, with, the driver 3 and the flywheel 4 at two symmetrical positions with respect to the virtual plane VP. Therefore, the ring member 5 can rotate in engagement with the flywheel 4 and the driver 3 in a stable attitude.

The above-described embodiment is explained merely as an example, and a driving tool according to the present invention is not limited to the above-described nailer 1. For example, following modifications or changes may be made. Further, one or more of these modifications or changes may be applied in combination with the nailer 1 shown in the embodiment, or with the claimed invention.

For example, the structure of the driver 3 may be modified to a driver 33 which is described below with reference to FIGS. 20 to 22. It is noted that the driver 33 of tins modified example has substantially the same structure as the driver 3 (see FIG. 2) of the above-described embodiment, except that a roller contact part 330 has a different structure from the roller contact part 301 of the above-described embodiment. Therefore, components which are substantially identical to those in the embodiment are given the same numerals as in the embodiment and will not be described or briefly described. In the following description, the different structure is mainly explained with reference to the drawings.

Figure 20:
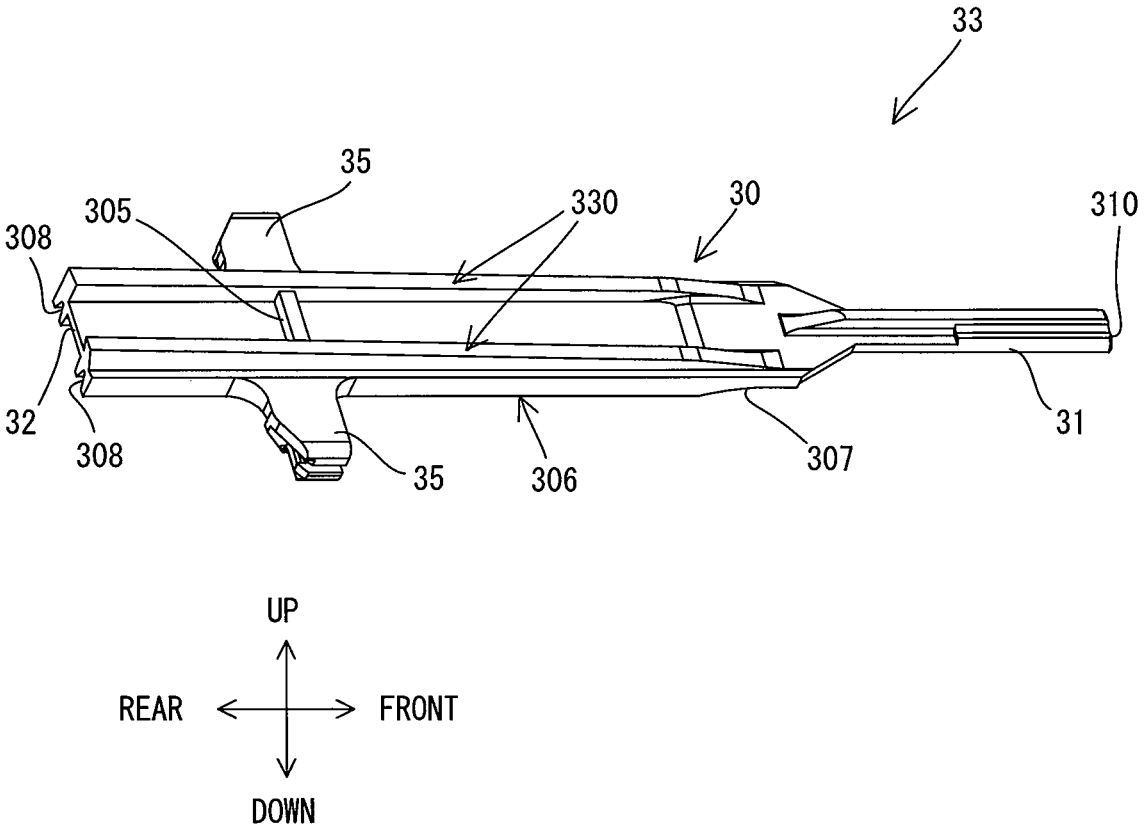
FIG. 20 is a perspective view showing a driver of a modified example as viewed from above.
Figure 21:
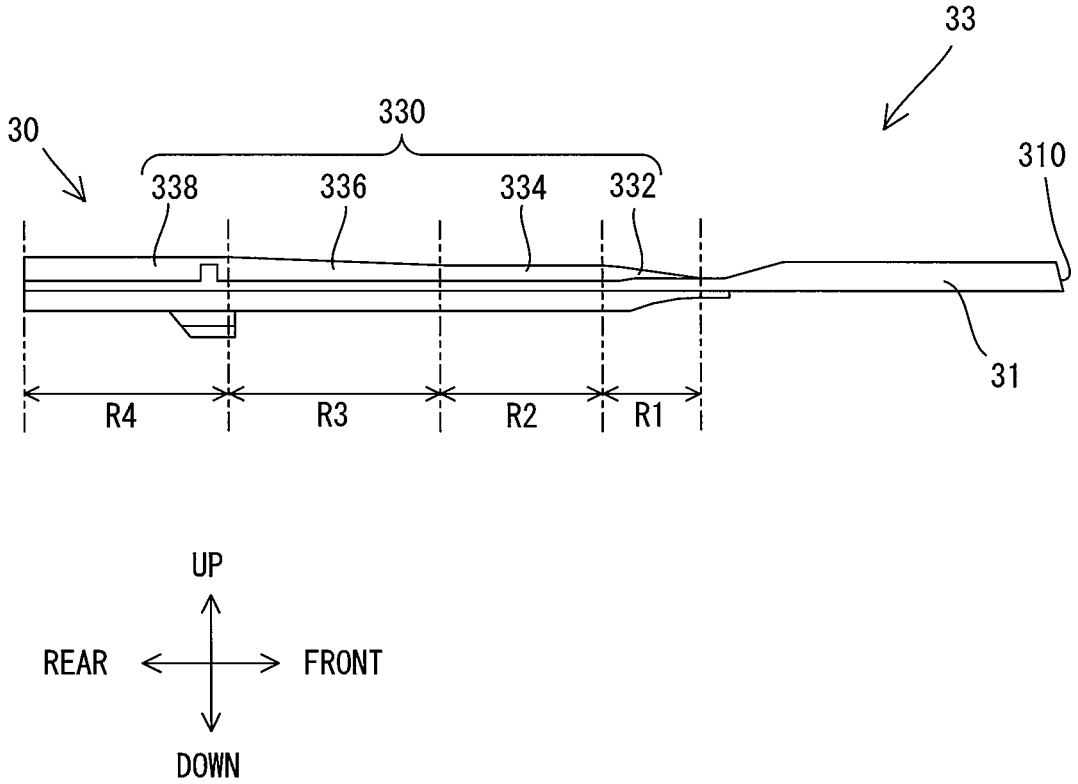
FIG. 21 is a side view showing the driver of the modified example.

As shown in FIG. 20, like the driver 3, the driver 33 includes the body 30, the striking part 31 and the pair of arms 35. The body 30 has a substantially rectangular plate-like shape as a whole and has a pair of roller contact parts 330, the lever contact part 305 and the pair of ring engagement parts 306.

The pair of roller contact parts 330 are configured to protrude upward from the upper surface of the body 30 and extend in the front-rear direction along the right and left edges of the body 30. Further, as shown in FIG. 21, each of the roller contact parts 330 includes a first inclined part 332, a first straight part 334, a second inclined part 336 and a second straight part 338. The first inclined part 332 is formed in a front end region of the roller contact part 330 and has a height in the up-down direction which increases toward the rear. The first straight part 334 is contiguously formed to extend rearward from the first inclined part 332 and has a constant height. The second inclined part 336 is contiguously formed to extend rearward from the first straight part 334 and has a height increasing toward the rear. The second straight part 338 is contiguously formed to extend rearward from the second inclined part 336 and has a constant height.

Upper surfaces of the first and second inclined parts 332, 336 may be formed straight in its entirety or gently curved at least in part in side view. Specifically, the upper surfaces (contact surfaces which come in contact with the pressing rollers 83) of the first and second inclined, parts 332, 336 may be flat or curved in its entirety, or may be flat in part and curved in part. Further, the inclinations of the first and second inclined parts 332, 336 may not be constant.

By providing the roller contact parts 330 having such a structure, the driver 33 of this modified example may be sectioned into a first region R1 corresponding to the first inclined parts 332, a second, region R2 corresponding to the first straight pans 334, a third region R3 corresponding to the second inclined parts 336 and a fourth region R4 corresponding to the second straight parts 338 in this order from a position corresponding to the front end of the roller contact part 330 toward the rear.

The thickness of the driver 33 gradually increases in the first region R1 and the third region R3 respectively due to the structure of the first and second inclined parts 332, 336. Here, the thickness of the driver 33 refers to a thickness of a part of the driver 33 which is disposed between the pressing roller 83 and the ring members 5 (in other words, a distance in the up-down direction between the upper surfaces of the roller contact parts 330 which come in contact with the pressing rollers 83 and the engagement positions between the ring engagement parts 306 and the ring members 5). The thickness of the driver 33 is constant in the second region R2 and the fourth region R4. Further, the first inclined part 332 of this modified example has the same structure as the inclined part 302 of the above-described embodiment. The first straight part 334 has the same height as the rear portion of the inclined part 302 of the roller contact part 301 of the above-described embodiment. Therefore, the driver 33 of this modified example has a larger thickness than the driver 3 by the increase in the thickness of the third region R3.

The operation of the nailer 1 when the driver 33 of this modified example is driven by the driver driving mechanism 9 is described below with reference to FIGS. 1, 4, 14 and 22. Although the driver 3 is shown in FIGS. 1, 4 and 14, the arrangement of the driver 33 and the driver driving mechanism 9 in the initial position, the transmitting position and the driving position itself is basically the same as the arrangement of the driver 3 and the driver driving mechanism 9. Therefore, FIGS. 1, 4 and 14 are also used as-is for the following explanation.

When the driver 33 is located at the initial position, the pressing rollers 83 are held at the lowermost position in contact with the upper surfaces of front end portions of the first inclined parts 332 in the same manner as shown in FIG. 1. At this time, the ring members 5 are held at the separate position apart from the corresponding ring engagement parts 306. When the trigger 14 is depressed and the lever 711 pushes the driver 33 forward, the driver 33 is moved forward while the first region R1 corresponding to the first inclined parts 332 is pressed from above by the pressing rollers 83, and a part of the outer periphery engagement part 51 of each of the ring members 5 comes in contact with the opening edges of the corresponding engagement groove 308 (see FIG. 20) of the driver 33. Then the driver 33 is further moved forward while the first region R1 pushes up the pressing rollers 83 against the biasing force of the disc springs 85 and pushes down the ring members 5 against the biasing force of the flat springs 63.

When the driver 33 reaches the transmitting position and the ring member 5 has moved to the contact position, the driver 33 and a part of the outer periphery engagement part 51 of the ring member 5 are frictionally engaged with each other, and the flywheel 4 and a part of the inner periphery engagement part 53 of the ring member 5 are frictionally engaged with each other. At this time, in the same manner as shown in FIG. 14, the pressing rollers 83 are held in contact with the upper surfaces of the rear end portions of the first inclined parts 332 of the roller contact parts 330. The driver 33 receives the rotational energy of the flywheel 4 which is transmitted by the ring members 5 and moves forward from the transmitting position. By this movement, the pressing rollers 83 each come in contact with an upper surface of the first straight part 334. Then, the ring members 5 are further pressed against the flywheel 4 via the driver 33 by the biasing force of the disc springs 85. Therefore, firmer factional engagements are established between the driver 33 and a part of the outer periphery engagement part 51 and between the flywheel 4 and a part of the inner periphery engagement part 53. In this state, the driver 33 reaches the striking position shown in FIG. 22.

Figure 22:
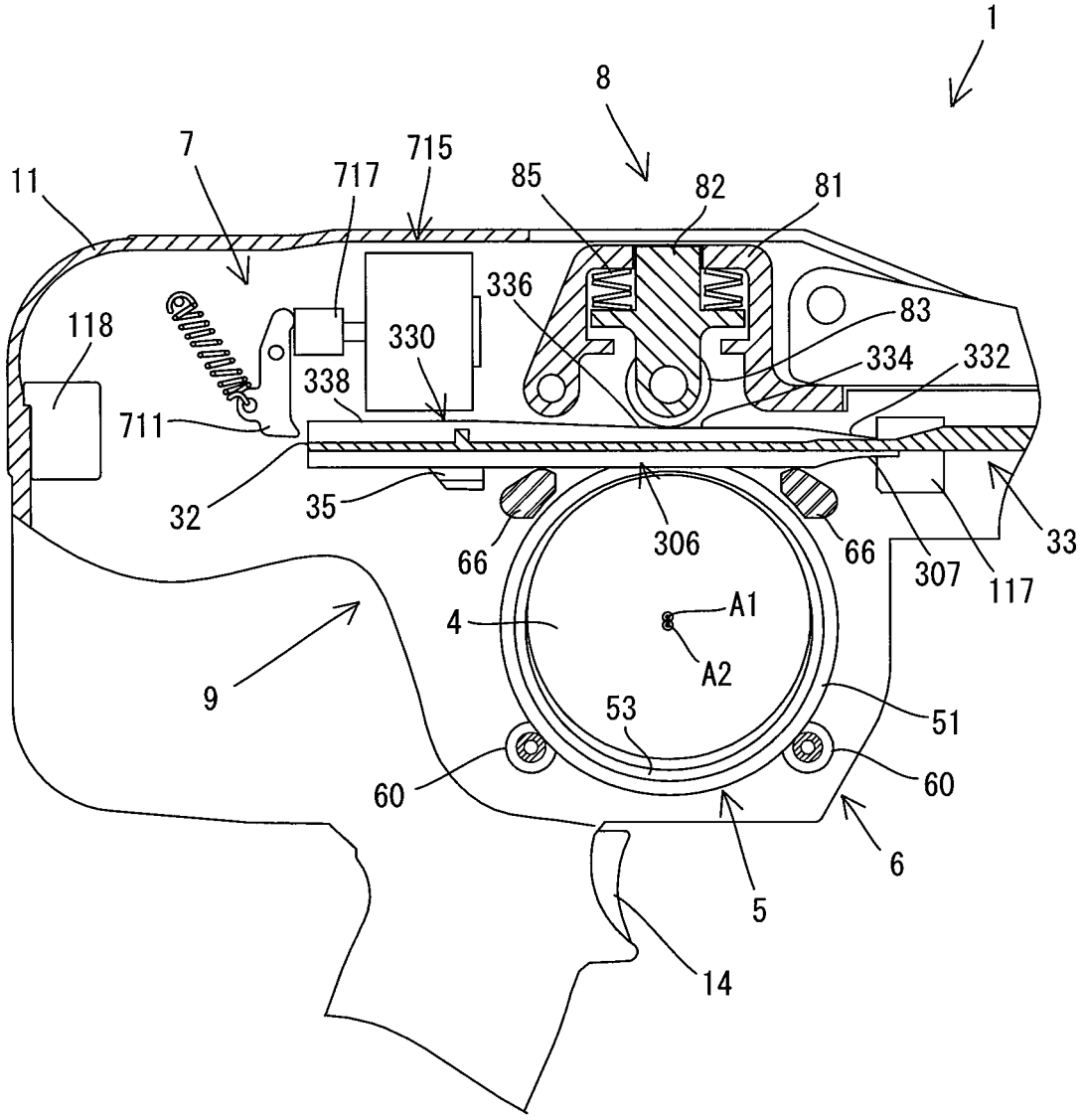
FIG. 22 is an explanatory view showing the driver of the modified example in the striking position and the driver driving mechanism.

As shown in FIG. 22, when the driver 33 is located at the striking position, each of the pressing rollers 83 is held in contact with a vicinity of a boundary between the upper surface of the first straight part 334 and an upper surface of the second inclined part 336. Therefore, when the driver 33 strikes the nail 101 and further moves forward, the pressing roller 83 comes in contact with the upper surface of the second inclined part 336. Thus, the driver 33 further moves forward while the third region R3 corresponding to the second inclined part 336 pushes up the pressing roller 83 against the biasing force of the disc spring 85. The driver 33 reaches the driving position shown in FIG. 4 while the pressing rollers 83 are pushed up to the uppermost position and each come in contact with an upper surface of the second straight part 338. In this stage, the elastic force of the disc springs 85 becomes the maximum.

As described above, in this modified example, like in the above-described embodiment, when the driver 33 moves from the initial position to the transmitting position, the pressing rollers 83 each come in contact with the upper surface (contact surface) of the first inclined part 332. The first region R1 (the front end part of the body 30) corresponding to the contact surfaces of the first inclined parts 332 is configured to have a thickness in the up-down direction which increases toward the rear. With such a structure, the first region R1 functions as a cam and further exhibits a wedge effect to efficiently move the ring members 5 toward the outer periphery 45 (the engagement groove s47) of the flywheel 4. Further, in this modified example, the driver 33 also has the third region R3 configured to have a thickness in the up-down direction which increases toward the rear. The third region R3 corresponds to a section of the contact surface (that is, the upper surfaces of the second inclined part 336 and the second straight part 338) which comes in contact with the pressing roller 83 when the driver 33 moves from the striking position to the driving position. The driver 33 receives reaction force (resistance) from the nail 101 after the driver 3 strikes the nail 101 at the striking position and until the driver 33 completes the operation of driving the nail 101 into the workpiece 100 at the driving position. Particularly, the reaction force (resistance)

increases as a tip of the nail 101 is stuck in the workpiece 100 and driven into the workpiece 100. Meanwhile, the third region R3 pushes up the pressing rollers 83, so that the elastic force of the disc springs 85 is enhanced. Thus, the driver 33 can be prevented from sliding with respect to the ring member 5 by the reaction force from the nail 101.

In this modified example, only the third region R3, which is a section of a region of the driver 33 corresponding to the contact surface (that is, the upper surfaces of the second inclined part 336 and the second straight part 338) with which the pressing roller 83 comes in contact when the driver 33 moves from the striking position to the driving position, is formed to have a thickness increasing toward the rear. However, another section of a region corresponding to the contact surface (that is, the whole upper surfaces extending from a rear end of the first inclined part 332 to a rear end of the second straight part 338) with which the pressing roller 83 comes in contact when the driver 33 moves from the transmitting position to the driving position may be configured to have a thickness increasing toward the rear. For example, only the second region R2 may be formed to have a thickness increasing toward the rear. A section of a region integrating the third region R3 and the fourth region R4 may be formed to have a thickness increasing toward the rear. Both the third region R3 and the fourth region R4 or the whole region extending from the second region R2 to the fourth region R4 may be formed to have a thickness increasing toward the rear.

The driving tool may be another type of driving tool for driving out a fastener other than the nail 101. For example, it may be embodied as a tacker or a staple gun for driving out a tack, a rivet, a pin, a staple or the like. Further, the driving source of the flywheel 4 is not particularly limited to the motor 2. For example, an AC motor may be used in place of the DC motor.

Engagement of the ring member 5 with the driver 3 and with the flywheel 4 is not limited to the engagement exemplified in the above-described embodiment. For example, the number of the ring members 5 and the numbers of the engagement grooves 308 of the driver 3 and the engagement grooves 47 of the flywheel 4 corresponding to the number of the ring members 5 may be one, or three or more. Further, for example, the shapes, arrangements, numbers and engagement positions of the outer and inner periphery engagement parts 51, 53 and the corresponding engagement grooves 308 and 47 may be appropriately changed. For example, the outer periphery engagement part 51 and the inner periphery engagement part 53 of the ring member 5 are both formed as projections, but one or both of them may be formed as a recess. In this case, one or both of the driver 3 and the flywheel 4 is provided with a projection which is engageable with the recess.

In the above-described embodiment, the ring member 5 has a larger diameter than the flywheel 4. Therefore, the ring member 5 is always disposed between the driver 3 and the flywheel 4 in the radial direction of the flywheel 4, so that the driver 3 is reliably prevented from coming in contact with the flywheel 4. The structures of the ring member 5 and the flywheel 4 may however be appropriately changed, provided that the ring member 5 and the flywheel 4 can rotate around different rotation axes in factional engagement with each other. For example, the flywheel 4 may be formed to have a central part having a smaller diameter than its opposite ends in the direction of the rotation axis A1 of the flywheel 4, and the ring member 5 may be formed to have a larger inner diameter than the diameter of the central part of the flywheel 4 and a smaller outer diameter than the diameter of the opposite ends of the flywheel 4. The ring member 5 may be disposed around the outer periphery of the central part of the flywheel 4 in such a manner as to be allowed to frictionally engage with the flywheel 4. In this case, the driver 3 may be configured to frictionally engage with the ring member 5 while being kept apart from the flywheel 4.

It is only necessary for the ring member 5 to be held such that the ring member 5 is not allowed to transmit the rotational energy of the flywheel 4 to the driver 3 when the driver 3 is placed in the initial position, while the ring member 5 starts the transmission when the driver 3 is moved to the transmitting position. For example, the structures of the ring biasing part 60 and the stopper 66 of the holding mechanism 6 may be appropriately changed.

A mechanism other than the actuating mechanism 7 may be used to move the driver 3 from the initial position to the transmitting position. For example, the mechanism may be configured to push the driver 3 toward the ring member 5 by a roller which is provided above the driver 3 placed in the initial position, in order to move the driver 3 to the transmitting position in which the ring member 5 is allowed to transmit the rotational energy of the flywheel 4 to the driver 3.

In the above-described embodiment, the pressing mechanism 8 is configured to press the driver 3 downward toward the ring members 5 by using the disc springs 85 as a biasing member in the process in which the driver 3 moves from the initial position to the driving position, but the driver 3 need not necessarily be pushed toward the ring member 5. For example, in place of the pressing mechanism 8, a mechanism which merely prevents the driver 3 from moving in a direction (upward) away from the flywheel 4 may be provided. For example, a guide roller may be provided which guides the driver 3 to move along the movement axis L while being held so as not to move in the up-down direction and held in contact with the driver 3 from above. Further, the number of tire pressing rollers 83 and the kind of the biasing member in the pressing mechanism 8 may be appropriately changed.

In view of the nature of the present invention and the above-described embodiment, the following features (aspects) are provided. Each of the features can be employed separately or in combination with at least one of the others, or in combination with the nailer 1 of the present embodiment or the claimed invention.

Aspect 1

The ring member may have a larger diameter than the flywheel.

Aspect 2

The holding mechanism may include:

a support, member configured to rotatably support the ring member, a biasing member configured to bias the ring member supported by the support member toward the outer periphery, and a stopper configured to hold the ring member at the separate position against the biasing force of the biasing member.

Aspect 3

The driver moving mechanism may include:

an operating member that is disposal to be movable between a first position in which the operating member is apart from the driver and a second position in which the operating member is in contact with the driver, and an actuator that is configured to move the operating member from the first position to the second position, wherein the operating member is configured to push the driver from the initial position toward the transmitting position when the operating member is moved from the first position to the second position by the actuator.

Aspect 4

The restricting part may include a contact member configured to come in contact with the driver and a biasing member configured to bias the driver toward the flywheel via the contact member in the facing direction.

Aspect 5

The driving tool as defined in claim 9, wherein:

the contact surface includes a specific section configured to come in contact with the contact member when the driver moves from a position for striking the fastener to the driving position, and at least the section of the region may be at least a section of a region of the driver which corresponds to the specific section of the contact surface.

Correspondences between the features of the embodiment and the modified example and the features of the invention are as follows. The nailer 1 is an example that corresponds to the "driving tool" according to the present invention. The nail 101 is an example that corresponds to the "fastener" according to the present invention. The flywheel 4 is an example that corresponds to the "flywheel" according to the present invention. The driver 3, 33 is an example that corresponds to the "driver" according to the present invention. The ring member 5 is an example that corresponds to the "ring member" according to the present invention. The actuating mechanism 7 is an example that corresponds to the "driver moving mechanism" according to the present invention. The holding mechanism 6 is an example that corresponds to the "holding mechanism" according to the present invention. The pressing mechanism 8 is an example that corresponds to the "restricting part" according to the present invention. The outer periphery engagement part 51 and the inner periphery engagement part 53 are example that correspond to the "first engagement part" and the "second engagement part", respectively, according to the present invention. The engagement groove 308 and the engagement groove 47 are examples that correspond to the "groove formed in the driver in the direction of the movement axis" and the "groove formed in the outer periphery of the flywheel in a circumferential direction", respectively, according to the present invention. The pressing roller 83 is an example that corresponds to the "contact member" according to the present invention. The disc springs 85 are an example that corresponds to the "biasing member" according to the present invention. The whole upper surfaces of the real-end portion of the first inclined part 332, the first straight part 334, the second inclined part 336 and the second straight part 338 are an example that corresponds to the "contact surface" according to the present invention. The region integrating the rear end portion of the first region R1, the second region R2, the third region R3 and the fourth region R4 is an example that corresponds to the "region of the driver that corresponds to the contact surface (contact region)" according to the present invention. The upper surfaces of the second inclined part 336 and the second straight part 338 are an example that corresponds to the "specific section of the contact surface" according to the present invention. The third region R3 and the fourth region R4 are an example that corresponds to the "region of the driver that corresponds to the specific section of the contact surface" according to the present invention.

DESCRIPTION OF THE NUMERALS

1: nailer
10: body
11: housing
115: support
117: front stopper
118: rear stopper
12: nose
123: injection port
125: contact arm
13: handle
14: trigger
15: battery mounting part
17: magazine
18: controller
19: battery
2: motor
21: pulley
25: belt
3, 33: driver
30: body
301, 330: roller contact part
302: inclined part
332: first inclined part
334: first straight part
336: second inclined part
338: second straight part
305: lever contact part
306: ring engagement part
307: inclined part
308: engagement groove
31: striking part
310: front end
32: rear end
332: first inclined part
334: first straight part
336: second inclined part
338: second straight part
35: arm
4: flywheel
40: through hole
41: pulley
45: outer periphery
47: engagement groove
5: ring member
51: outer periphery engagement part
53: inner periphery engagement part
6: holding mechanism
60: ring biasing part
61: support member
612: flange
613: support groove
615 through hole
62: support shaft

63: flat spring
66: stopper
665: guide groove
7: actuating mechanism
711: lever
712: pin
713: tension coil spring
715: solenoid
716: frame
717: operating part
8: pressing mechanism
81: frame
811: housing space
813: locking part
82: roller holding part
821: upper part
822: spring receiving part
823: lower end part
83: pressing roller
84: roller support shaft
85: disc spring
9: driver driving mechanism
100: workpiece
101: nail
A1: rotation axis
A2: rotation axis
L: movement axis
VP: virtual plane
R1: first region
R2: second region
R3: third region
R4: fourth region

What is claimed is:

1. A driving tool configured to drive a fastener into a workpiece by driving out the fastener, the driving tool comprising:

a flywheel configured to be rotationally driven around a first rotation axis, a driver disposed to face an outer periphery of the flywheel in a radial direction of the flywheel and held to be movable between an initial position and a driving position along a movement axis, a ring member configured to transmit rotational energy of the flywheel to the driver, wherein:

the ring member is a single annular member, and an outer periphery of the ring member is located radially outward of the outer periphery of the flywheel and encircles the outer periphery of the flywheel, and a driver moving mechanism configured to move the driver with respect to the ring member from the initial position to a transmitting position in which the ring member is capable of transmitting the rotational energy to the driver, wherein:

when the driver is placed in the initial position, the ring member is disposed loosely around the outer periphery of the flywheel, and when the driver is moved to the transmitting position by the driver moving mechanism, the ring member is frictionally engaged with the driver and with the flywheel, and rotated by the flywheel around a second rotation axis, the second rotation axis being different from the first rotation axis, and the ring member transmits the rotational energy to the driver, thereby pushing the driver in a driving direction from the transmitting position toward the driving position.

2. The driving tool as defined in claim 1, further comprising:

a holding mechanism configured to hold the ring member such that the ring member is movable between a separate position and a contact position, the ring member being held apart from the outer periphery of the flywheel in the separate position, and the ring member being held in partial contact with the outer periphery in the contact position, wherein:

when the driver is placed in the initial position, the holding mechanism holds the ring member at the separate position, and when the driver is moved to the transmitting position by the driver moving mechanism, the holding mechanism holds the ring member, which is moved in response to a movement of the driver, at the contact position.

3. The driving tool as defined in claim 1, wherein:

the transmitting position is located between the initial position and the driving position in a direction of the movement axis, and the driver moving mechanism is configured to push the driver from the initial position toward the transmitting position along the movement axis.

4. The driving tool as defined in claim 3, further comprising:

a restricting part configured to restrict a movement of the driver away from the flywheel in a facing direction in which the driver and the outer periphery face each other, wherein:

the driver has an inclined part configured to come in contact with the ring member in a process in which the driver moves from the initial position to the transmitting position, and the inclined part is configured to have a thickness in the facing direction that gradually increases in a direction opposite to the driving direction.

5. The driving tool as defined in claim 3, further comprising:

a restricting part configured to restrict a movement of the driver away from the flywheel in a facing direction in which the driver and the outer periphery face each other, wherein:

the restricting part includes:

a contact member configured to come in contact with the driver; and a biasing member configured to bias the driver, via the contact member, toward the flywheel in the facing direction, the driver has a contact surface configured to come in contact with the contact member when the driver moves from the transmitting position to the driving position, and at least a section of a contact region of the driver is configured to have a thickness in the facing direction which gradually increases in a direction opposite to the driving direction, the contact region being a region of the driver that corresponds to the contact surface in the direction of the movement axis.

6. The driving tool as defined in claim 1, wherein:

the driver includes two engagement parts extending in the direction of the movement axis, the two engagement parts being disposed on opposite sides of the movement axis, and the driving tool includes two of the ring members, the two of the ring members being engageable with the two engagement parts of the driver, respectively.

7. The driving tool as defined in claim 1, wherein the ring member has a larger diameter than the flywheel.

8. The driving tool as defined in claim 2, wherein the holding mechanism includes:

a support member configured to rotatably support the ring member;

a biasing member configured to bias the ring member supported by the support member toward the outer periphery of the flywheel; and a stopper configured to hold the ring member at the separate position against a biasing force of the biasing member.

9. The driving tool as defined in claim 4, wherein the restricting part includes:

a contact member configured to come in contact with the driver; and a biasing member configured to bias the driver toward the flywheel via the contact member in the facing direction.

10. The driving tool as defined in claim 5, wherein the contact surface includes a specific section configured to come in contact with the contact member when the driver moves from a striking position, in which the driver strikes the fastener, to the driving position and the section of the contact region is a section of a region of the driver that corresponds to the specific section of the contact surface.

11. A driving tool configured to drive a fastener into a workpiece by driving out the fastener, the driving tool comprising:

a flywheel configured to be rotationally driven around a first rotation axis, a driver disposed to face an outer periphery of the flywheel in a radial direction of the flywheel and held to be movable between an initial position and a driving position along a movement axis, a ring member configured to transmit rotational energy of the flywheel to the driver, and a driver moving mechanism configured to move the driver with respect to the ring member from the initial position to a transmitting position in which the ring member is capable of transmitting the rotational energy to the driver, wherein:

when the driver is placed in the initial position, the ring member is disposed loosely around the outer periphery of the flywheel, when the driver is moved to the transmitting position by the driver moving mechanism, the ring member is frictionally engaged with the driver and with the flywheel, and rotated by the flywheel around a second rotation axis, the second rotation axis being different from the first rotation axis, and the ring member transmits the rotational energy to the driver, thereby pushing the driver in a driving direction from the transmitting position toward the driving position, the ring member includes:

a first engagement part configured to be engageable with the driver, and a second engagement part configured to be engageable with the flywheel, and the first and second engagement parts are formed as:

projections configured to be engageable, respectively, with a groove formed in the driver in the direction of the movement axis, and a groove formed in the outer periphery of the flywheel in a circumferential direction, or recesses configured to be engageable, respectively, with a projection formed in the driver in the direction of the movement axis, and a projection formed in the outer periphery in the circumferential direction.

12. The driving tool as defined in claim 11, wherein:

the first engagement part is configured to engage with the groove or the projection of the driver at two engagement positions in a direction of the second rotation axis, the second engagement part is configured to engage with the groove or the projection of the flywheel at two engagement positions in the direction of the second rotation axis, and a virtual plane perpendicular to the second rotation axis and passing a midpoint, in the direction of the second rotation axis, between the two engagement positions at which the first engagement part and the driver engage with each other also passes a midpoint, in the direction of the second rotation axis, between the two engagement positions at which the second engagement part and the flywheel engage with each other.

13. The driving tool as defined in claim 12, wherein both the first and second engagement parts are symmetrically formed with respect to the virtual plane.

14. A driving tool configured to drive a fastener into a workpiece by driving out the fastener, the driving tool comprising:

a flywheel configured to be rotationally driven around a first rotation axis, a driver disposed to face an outer periphery of the flywheel in a radial direction of the flywheel and held to be movable between an initial position and a driving position along a movement axis, a ring member configured to transmit rotational energy of the flywheel to the driver, and a driver moving mechanism configured to move the driver with respect to the ring member from the initial position to a transmitting position in which the ring member is capable of transmitting the rotational energy to the driver, wherein:

when the driver is placed in the initial position, the ring member is disposed loosely around the outer periphery of the flywheel, when the driver is moved to the transmitting position by the driver moving mechanism, the ring member is frictionally engaged with the driver and with the flywheel, and rotated by the flywheel around a second rotation axis, the second rotation axis being different from the first rotation axis, and the ring member transmits the rotational energy to the driver, thereby pushing the driver in a driving direction from the transmitting position toward the driving position, and the driver moving mechanism includes:

an operating member disposed to be movable between a first position and a second position, the operating member being apart from the driver in the first position, and the operating member being in contact with the driver in the second position; and an actuator configured to move the operating member from the first position to the second position, wherein the operating member is configured to push the driver from the initial position toward the transmitting position when the operating member is moved from the first position to the second position by the actuator.

* * * * *